US011542746B2

(12) United States Patent
Header

(10) Patent No.: US 11,542,746 B2
(45) Date of Patent: Jan. 3, 2023

(54) SILL ASSEMBLY AND SUBSILL FOR THE SAME

(71) Applicant: Solar Innovations LLC, Pine Grove, PA (US)

(72) Inventor: Gregory A Header, Richland, PA (US)

(73) Assignee: Solar Innovations LLC, Pine Grove, PA (US)

( * ) Notice: Subject to any disclaimer, the term of this patent is extended or adjusted under 35 U.S.C. 154(b) by 159 days.

(21) Appl. No.: 16/949,952

(22) Filed: Nov. 20, 2020

(65) Prior Publication Data

US 2022/0162901 A1 May 26, 2022

(51) Int. Cl.
*E06B 1/70* (2006.01)

(52) U.S. Cl.
CPC ..... *E06B 1/702* (2013.01)

(58) Field of Classification Search
CPC ..... E06B 1/702
See application file for complete search history.

(56) References Cited

U.S. PATENT DOCUMENTS

| | | | |
|---|---|---|---|
| 258,486 | A | 5/1882 | Singer |
| 448,501 | A | 3/1891 | Bussert |
| 586,467 | A | 7/1897 | Vogel |
| 1,677,130 | A | 7/1928 | Cherry |
| 3,410,027 | A | 11/1968 | Bates |
| 3,503,169 | A | 3/1970 | Johnson et al. |
| 3,866,369 | A | 2/1975 | Paull |
| 4,553,361 | A | 11/1985 | Ralph |
| 5,179,804 | A | 1/1993 | Young |
| 5,687,508 | A | 11/1997 | Fitzhenry, Jr. et al. |
| 5,921,038 | A | 7/1999 | Burroughs et al. |
| 6,371,188 | B1 | 4/2002 | Baczuk et al. |
| 7,367,164 | B2 | 5/2008 | Burton et al. |
| 7,600,346 | B2 | 10/2009 | Meeks |
| 7,669,369 | B2 | 3/2010 | Henry et al. |
| 7,775,004 | B2 | 8/2010 | Allen |

(Continued)

FOREIGN PATENT DOCUMENTS

| | | | |
|---|---|---|---|
| JP | H05321537 | A | 12/1993 |
| KR | 20100103273 | A | 9/2010 |

(Continued)

OTHER PUBLICATIONS

Deborah Slaton, David S. Patterson, Jeffery N. Sutterlin, Storefronts: Test the subsill, Jun. 22, 2015, The Construction Specifier, downloaded from the Internet from: https://www.constructionspecifier.com/storefrontstestthesubsill/ on Feb. 27, 2020.

(Continued)

*Primary Examiner* — Andrew J Triggs
(74) *Attorney, Agent, or Firm* — Stone Creek Services LLC; Alan M Flum

(57) ABSTRACT

A subsill positioned at least partially under a sill in a sill assembly. The sill assembly positioned under a door or window. Two or more pressure chambers extend lengthwise between the subsill and sill. Pressure chambers can extend one behind another. The subsill can include a backstop with some of the pressure chambers extending lengthwise between the backstop and the sill. Apertures in the pressure chambers are positioned to force water to flow by a circuitous path.

16 Claims, 27 Drawing Sheets

(56) References Cited

U.S. PATENT DOCUMENTS

| | | | | |
|---|---|---|---|---|
| 8,132,370 | B2 * | 3/2012 | Heppner | E06B 1/70 49/467 |
| 8,443,554 | B1 | 5/2013 | Teodorovich | |
| 8,448,384 | B2 | 5/2013 | Wernlund et al. | |
| 8,683,747 | B2 * | 4/2014 | Kim | E06B 7/14 49/404 |
| 9,062,490 | B2 | 6/2015 | Kadavy et al. | |
| D742,483 | S | 11/2015 | Chapman et al. | |
| 9,982,477 | B1 | 5/2018 | Glickman et al. | |
| 10,087,678 | B2 | 10/2018 | Pettibone | |
| 10,337,239 | B2 * | 7/2019 | Header | E06B 3/365 |
| 11,346,147 | B2 * | 5/2022 | Header | E06B 3/26347 |
| 2003/0221381 | A1 * | 12/2003 | Ting | E06B 1/36 52/235 |
| 2005/0011140 | A1 | 1/2005 | Ackerman, Jr. et al. | |
| 2016/0281417 | A1 | 9/2016 | Harte | |
| 2017/0204654 | A1 | 7/2017 | Heid et al. | |
| 2022/0162901 | A1 * | 5/2022 | Header | E06B 1/702 |

FOREIGN PATENT DOCUMENTS

| | | | |
|---|---|---|---|
| WO | 2009086510 | A1 | 7/2009 |
| WO | 2018200491 | A1 | 11/2018 |

OTHER PUBLICATIONS

Alspec Customer Technical Memo #182, AS153S Sub Sill No Leg—New Die, Oct. 2, 2013, Aluminum Specialties Group Pty Ltd., Sidney, Australia.

Alspec Customer Technical Memo #74, Additions to Sub Head & Sub Sills and Awning Casement Window Technical Manuals, Jul. 17, 2009, Aluminum Specialties Group Pty Ltd., Sidney, Australia.

Alspec Customer Technical Memo #190, New Dies—Sub Heads and Sub Sills, Nov. 15, 2013, Aluminum Specialties Group Pty Ltd., Sidney, Australia.

Alspec Customer Technical Memo #246, Threshold AS1852, Jun. 2016, Aluminum Specialties Group Pty Ltd., Sidney, Australia.

Easyscreen Sub Framing, Feb. 27, 2011, Breezeway Australia Pty Limited, Brisbane, Australia.

Traco NX-Subsill, Kawneer North America, Atlanta, Georgia downloaded from the Internet from: https://www.kawneer.com/kawneer/adm_na/126_WINDOW%20ACCESSORIES%20-%20NX%20Series%20Products/030_Subsills/030_Subsills.pdf on Feb. 28, 2020.

Traco Subsill/Subsill Anchors, Kawneer North America, Atlanta, Georgia downloaded from the Internet from https://www.kawneer.com/kawneer/cad_na/4224/010%5FCAD%20Files/010.pdf on Feb. 28, 2020.

SureSill 4-9/16" Sloped Sill Pan for Windows and Doors Model 464 Features and Benefits, Mar. 22, 2014, SureSill, Ltd., Austin, Texas.

Commercial Sliding Door Series 442 Product Sheet, AWS, Downloaded from the Internet from: https://www.awsaustralia.com.au/Content/cms/awscdn/files/442_ProductSheet.pdf on Feb. 28, 2020.

Installation-Sub Gills, Dualfold Door, Sep. 2008, Designer Construction, Ltd., West Sussex, England.

SillDry Product Specifications, Feb. 11, 2020, Sill Dry Industries, LLC, Hatfield, Pennsylvania.

Waterproofing Requirements for Doorways to Decks and Balconies, Queensland Building and Construction Commission, Feb. 13, 2017, Downloaded from the Internet from https://www.qbcc.qld.gov.au/blog/tradie-talk/waterproofing-requirements-doorways-decks-balconies on Feb. 29, 2020.

Window Weep Holes Work | Anlin Windows & Doors, YouTube Video (Transcript), viewed on the Internet from https://www.youtube.com/watch?v=KZvPXNfafTMHow on Aug. 24, 2020.

* cited by examiner

SILL ASSEMBLY AND SUBSILL FOR THE SAME

BACKGROUND

The present disclosure relates to subsills that form the bottom structure of a sill assembly under a doorway or window.

Sills can create an air or moisture barrier between the inside and outside of a doorway or window. For example, a sill can weather seal the bottom of the door, preventing water and outside air from entering the building from underneath the door. It can also provide a drainage path for water that penetrates door or window seals.

Sills use many different strategies to prevent water from entering the inside of the doorway or window. One such strategy is to place the sill in a sill pan or pan flashing that surrounds the sill on the bottom, back, and sides, but is open on the front to allow water to drain out.

Another strategy is to use the sill in combination with a subsill. A subsill is a structural member placed between the sill and floor to capture water that penetrates the sill and drain the water out of the building structure. The sill sits on top of the subsill or partially in the subsill. A subsill typically has both a front wall and a back wall and typically uses attachable members, referred to as end dams to surround the ends of both the sill and the subsill. Water typically is drained out by gravity from the back of the subsill to the front of the subsill through apertures in the front wall known as weep holes.

One of the challenges facing sill and subsill designers is air and water infiltration through the sill and subsill. This can occur through the weep holes or through penetrations from fasteners in the sill and/or subsill. Weep flaps can be used over the weep holes to help reduce water infiltration through the weep holes. However, weep flaps can form imperfect seals, can be stuck open because of air blown debris, and over time can fail.

SUMMARY

The inventor's company manufactures sill assemblies for commercial and residential doors and windows. The inventor observed that he could slow water and air infiltration into the subsill, by lengthening the water and air path within a subsill, and thereby improve a sill assembly's resistance to air and water penetration. He accomplished this by creating a series of pressure chambers extending lengthwise (i.e. longitudinally) within the subsill and forcing water and air to take a circuitous rather than direct route throughout its path. Some of the pressure chambers can be arranged from back to front, one behind another. These pressure chambers can route water and air through apertures in the pressure chamber walls or partitions. These apertures can extend upward from the bottom of the subsill and through the chamber walls. The apertures can be positioned in such a way that forces water and air to take a circuitous path rather than a straight or direct path between entering and exiting the subsill.

Other pressure chambers can be arranged from top to bottom, one on top of another. These pressure chambers can be formed between the back of the subsill and the back of the sill. These pressure chambers can also route water and air circuitously. The top of the upper-most of these pressure chambers can form the bottom wall of a trough formed between the subsill and sill. This trough can capture water overflowing from the sill and route it to the subsill through apertures in the bottom wall of the trough.

The inventor also discovered that he could further improve the effective capacity of the sill assembly by dividing the sill assembly into more than one series of pressure chambers. For example, a first and second plurality of pressure chambers could be positioned side-by-side along the length of the sill assembly and divided by a barrier. If for example, water was to infiltrate through the first plurality of the pressure chambers through a defective weep flap, the water could overflow into the trough and flow into the second plurality of pressure chambers where it could drain out of the system.

Isolated overflow chamber assemblies equipped with back-flow preventers and drain tubes can provide additional drainage. These overflow chamber assemblies could capture excess water from the trough and drain it through a series of pressure chambers that are isolated from the primary pressure chambers. The excess water could enter the overflow chamber assembly through an aperture equipped with a back-flow preventer, such as a check valve or ball valve, to prevent back flow. Optionally, the water can drain out of the system through an exit port that drains into a French drain, drain channel, drain pipe, or other water carrier that is isolated from the rain and air pressure from outside of the door, sill, or subsill. A back-flow preventer such as a check valve or ball valve can be added to the exit port to prevent back flow of water from the drain into the subsill.

The structure that determines the routing of the water through the pressure chambers, as well as the structure of the pressure chambers themselves depends primarily on the structure of the subsill. Typically, the sill's structure, not the subsill, determines how the sill assembly will interact with the door. Therefore, the structure of the pressure chambers, the routing of water via circuitous routes, the trough, and overflow chambers can be implemented independent of door or window type since these features depend primarily on the subsill.

This Summary introduces a selection of concepts in simplified form that are described in the Description. The Summary is not exhaustive. Inclusion in the summary does not imply that a feature is essential. Exclusion from the summary does not imply that a feature is unimportant.

DRAWINGS

DESCRIPTION

Figure 1:
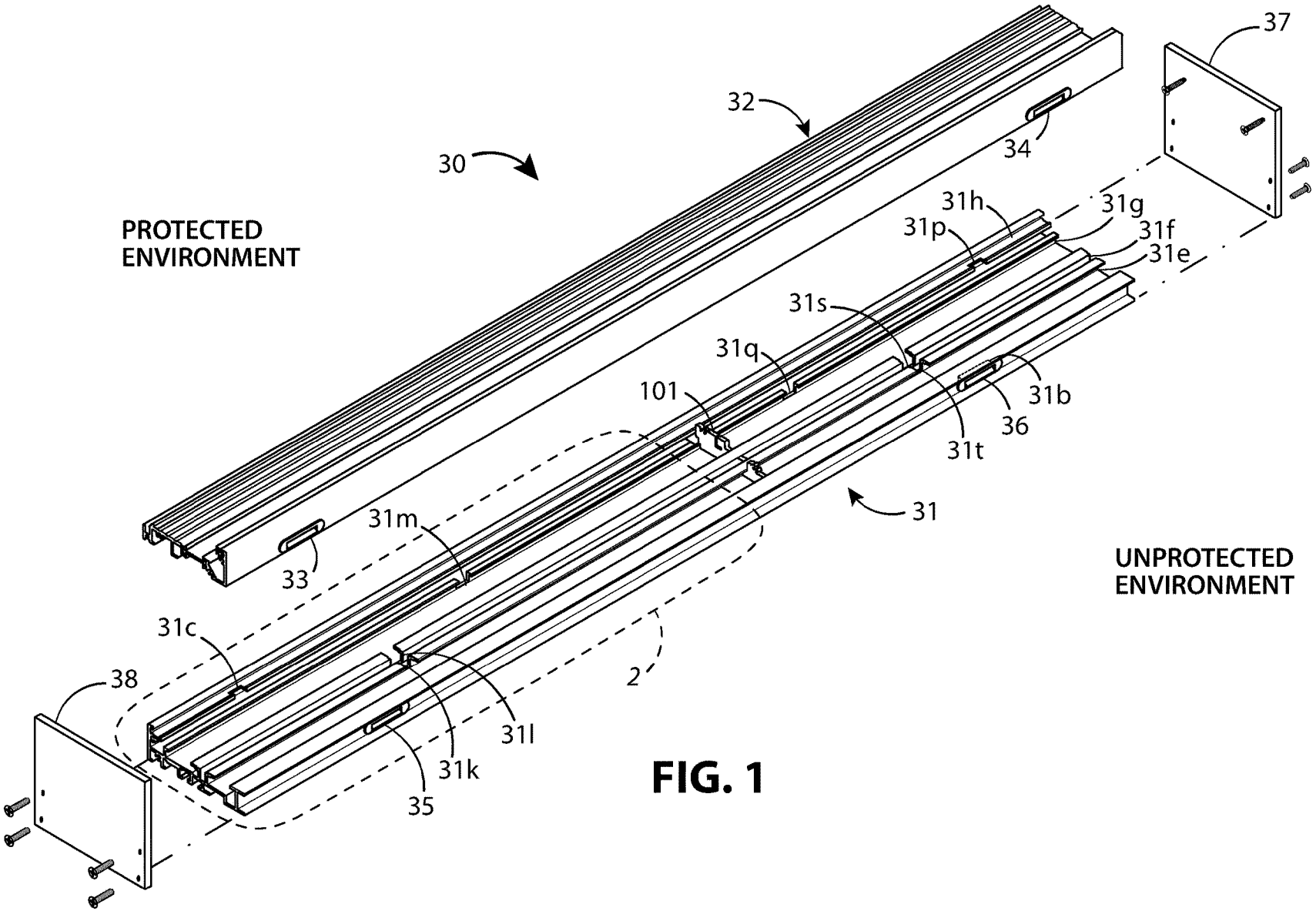
FIG. 1 illustrates a front and top perspective view of a sill assembly and end dams for a swing door with the sill and end dams exploded away from the subsill.

Throughout the Description, the terms "left" and "right" are relative terms that refer to the left and right side of the drawing sheet of the figure being described. When describing doorways, doors, sill assemblies, sills, or subsills, the term "front" refers to the portion of the door, window, sill, subsill, or sill assembly that faces the unprotected environment. The term "rear" refers to the portion of the door, window, sill, subsill, or sill assembly that the protected environment. Throughout the figures and text, the designation, "protected environment," refers to an area that is protected from undesirable environmental elements. Throughout the figures and text, the term "unprotected environment" refers to an area subject to environmental elements that the protected environment attempts to exclude. In a typical residential or commercial structure, the protected environment can refer to the interior of the building or structure. The unprotected environment can refer to the exterior of the building or structure. In this example, undesirable elements could be wind, rain, as well as hot, cold, or polluted air.

Specific dimensions are intended to help the reader understand the scale and advantage of the disclosed material. Dimensions given are typical and the claims are not limited to the recited dimensions.

Figure 3:
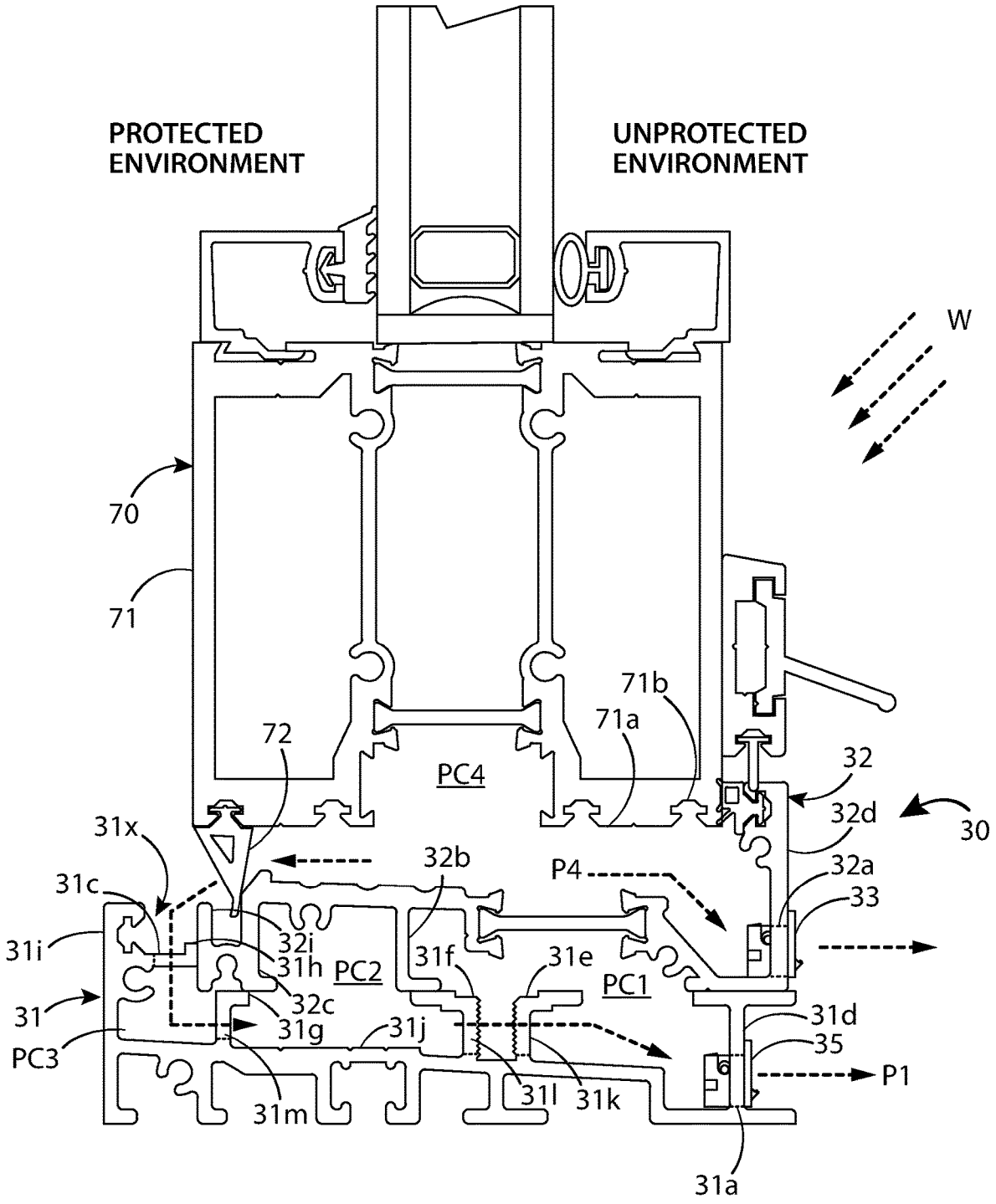
FIG. 3 illustrates a left-side view of the sill assembly of FIG. 1 and a portion of a swing door positioned over the sill assembly.
Figure 4:
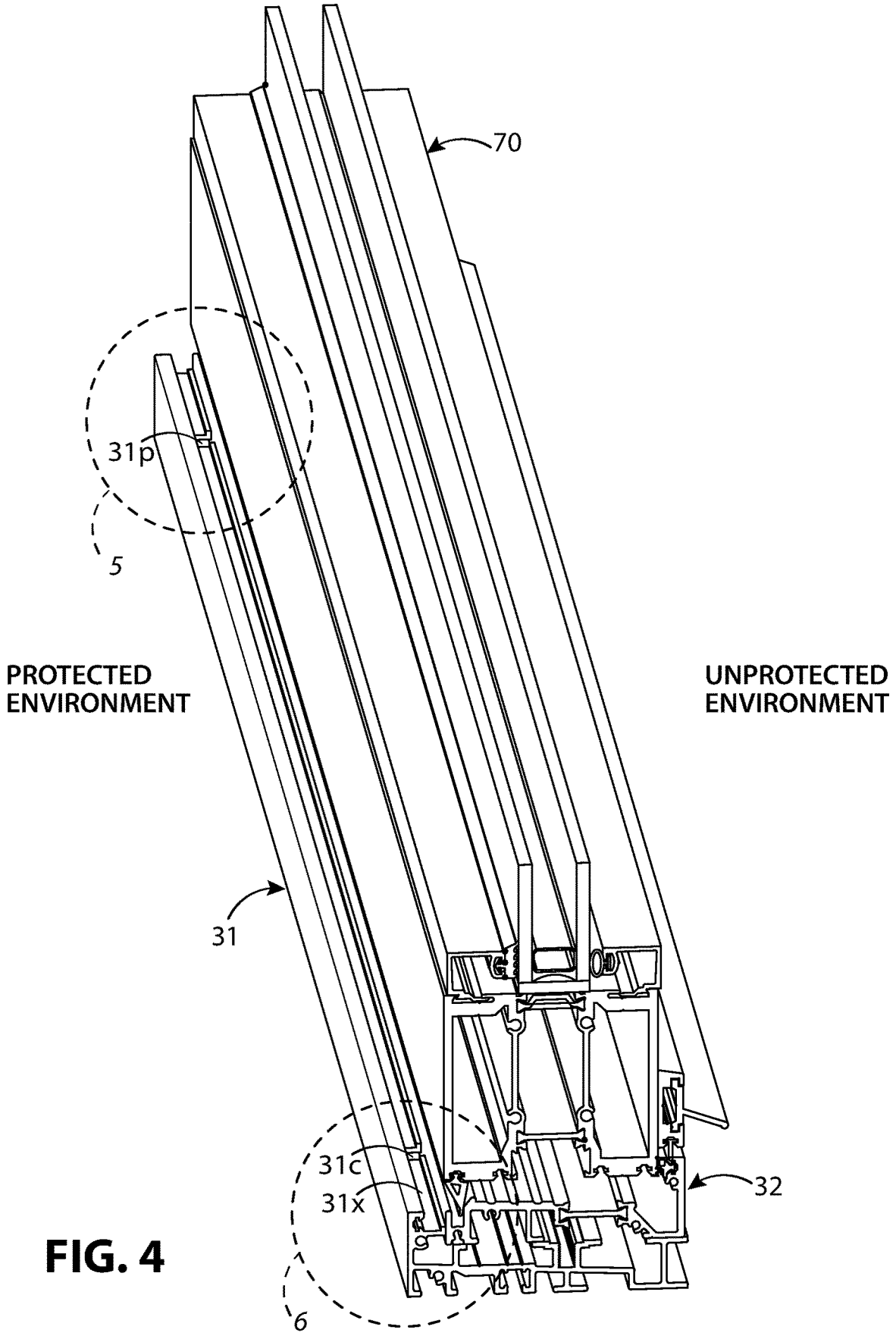
FIG. 4 illustrates a rear and top perspective view of the portion of the swing door assembly of FIG. 3.
Figure 7:
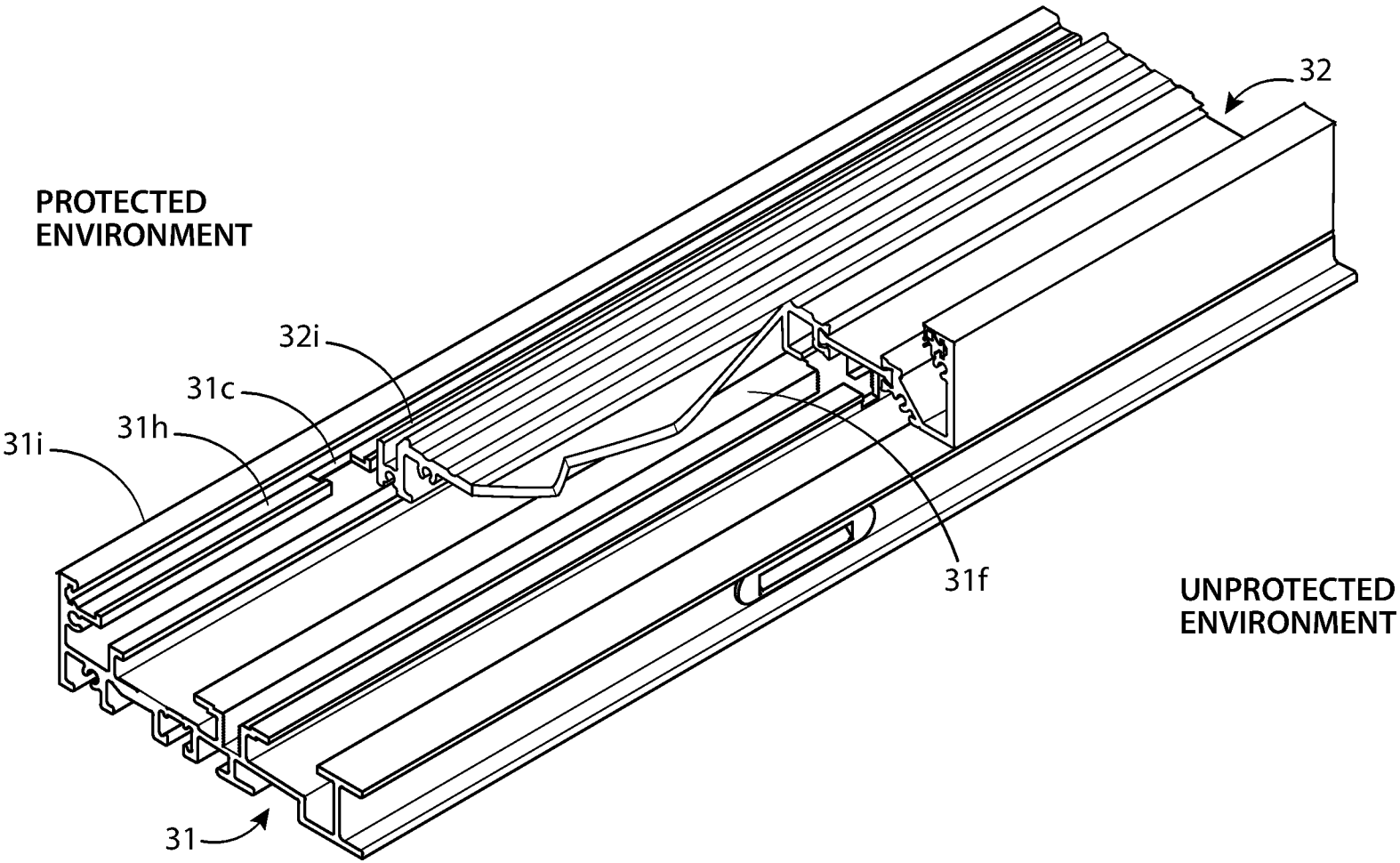
FIG. 7 illustrates a right-side portion, in perspective view, of the sill assembly of FIG. 1 with a portion of the sill cutaway to show the first upper drain aperture and an interior aperture.
Figure 8:
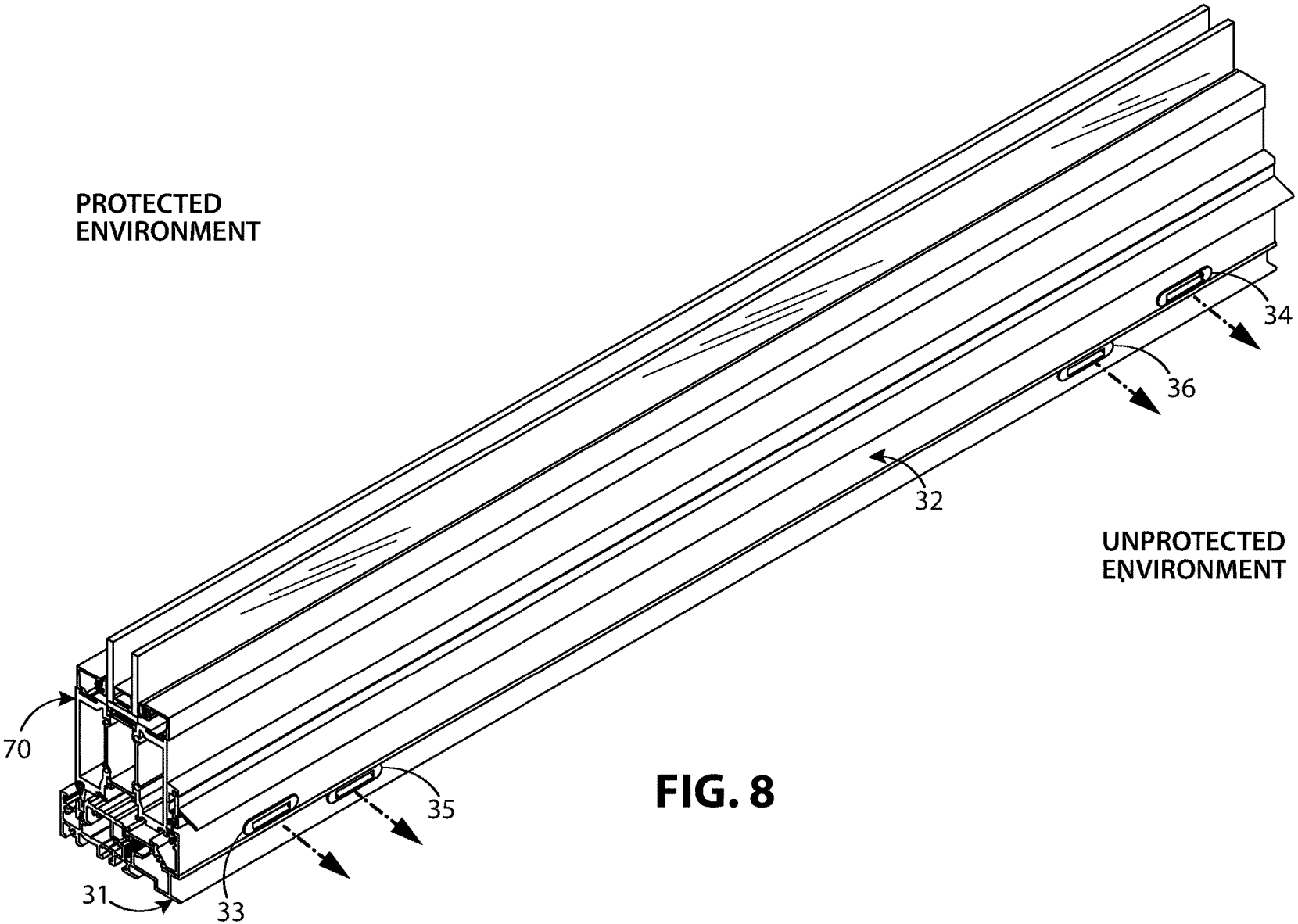
FIG. 8 illustrates a front perspective view the sill assembly and swing door portion of FIG. 3, showing the water drain path to the unprotected environment.
Figure 9:
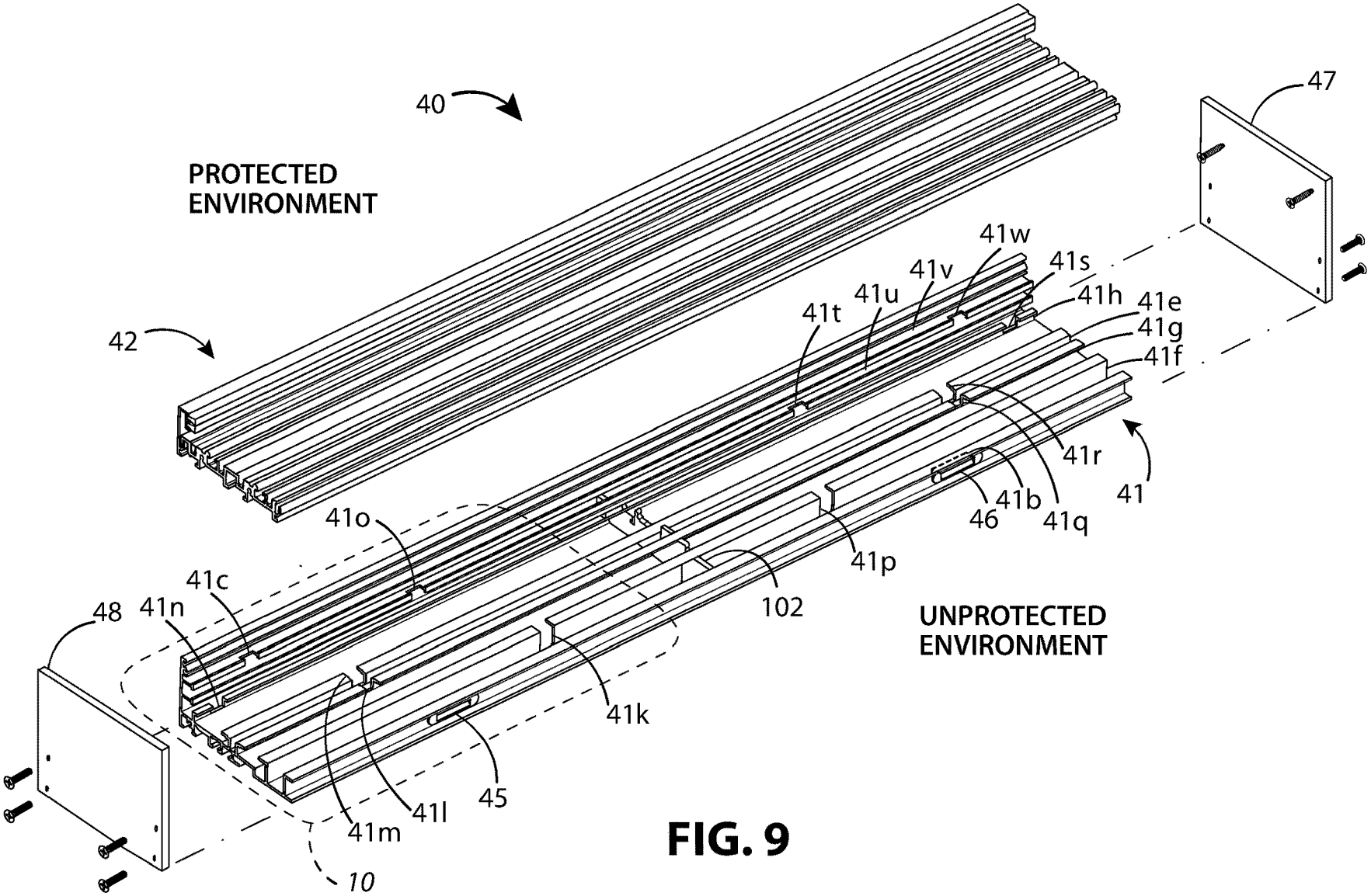
FIG. 9 illustrates a front and top perspective view of a sill assembly and end dams for a sliding door with the sill and end dams exploded away from the subsill.
Figure 11:
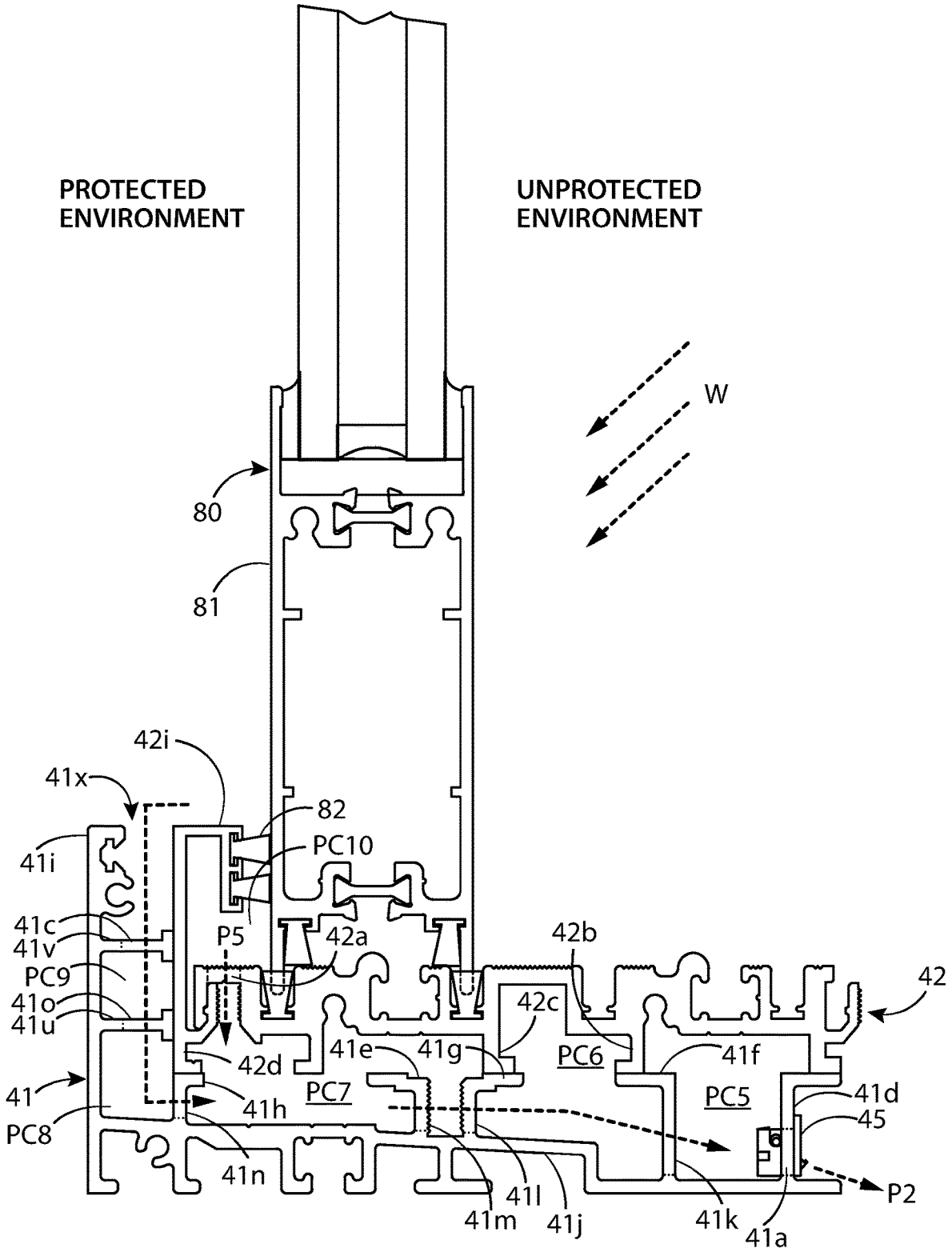
FIG. 11 illustrates a left-side view of the sill assembly of FIG. 9 and a portion of a sliding door positioned over the sill assembly.
Figure 12:
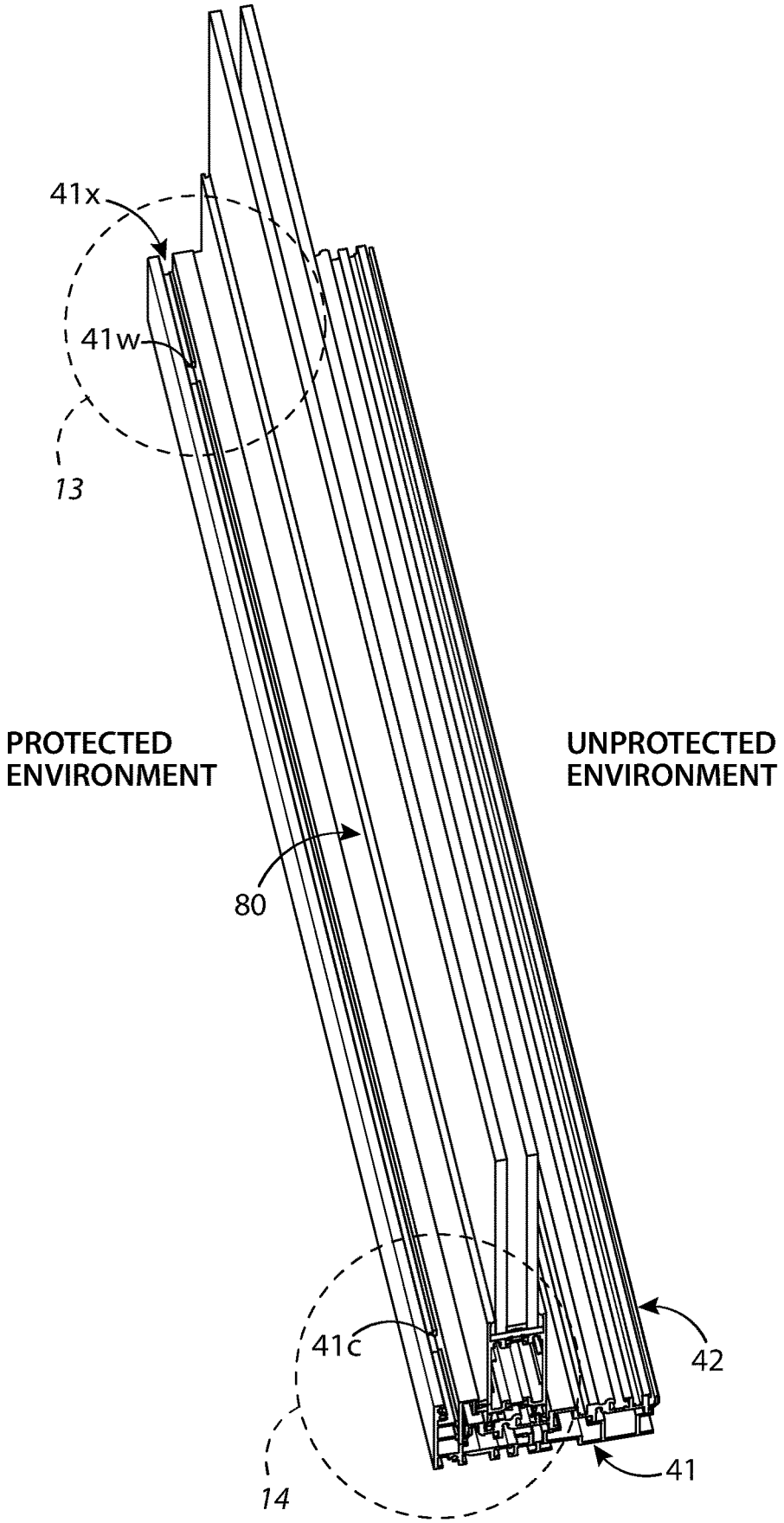
FIG. 12 illustrates a rear and top perspective view of the sill assembly and portion of the sliding door of FIG. 11.
Figure 17:
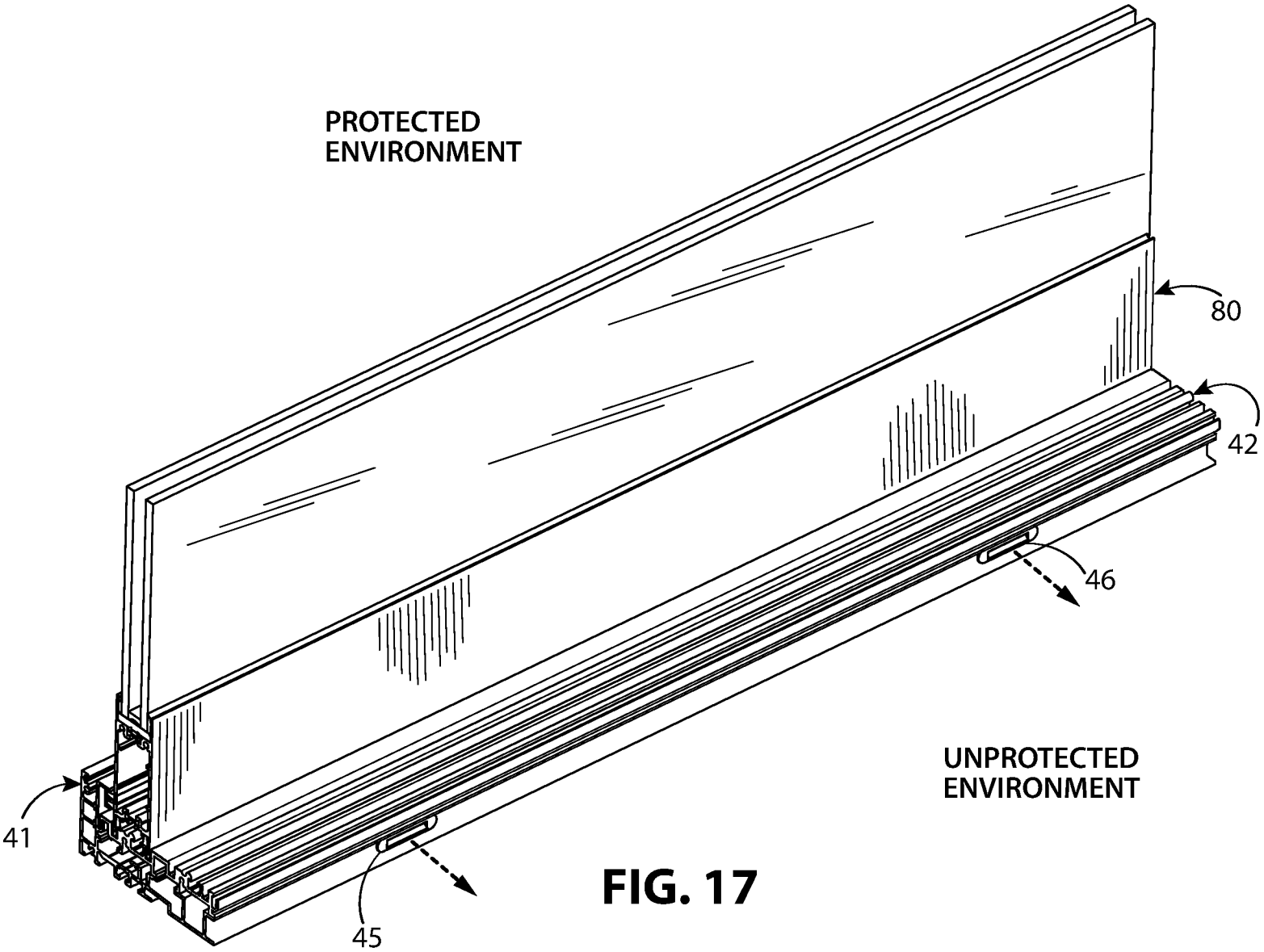
FIG. 17 illustrates a front perspective view the sliding door assembly portion of FIG. 11 showing the water drain path to the unprotected environment.
Figure 18:
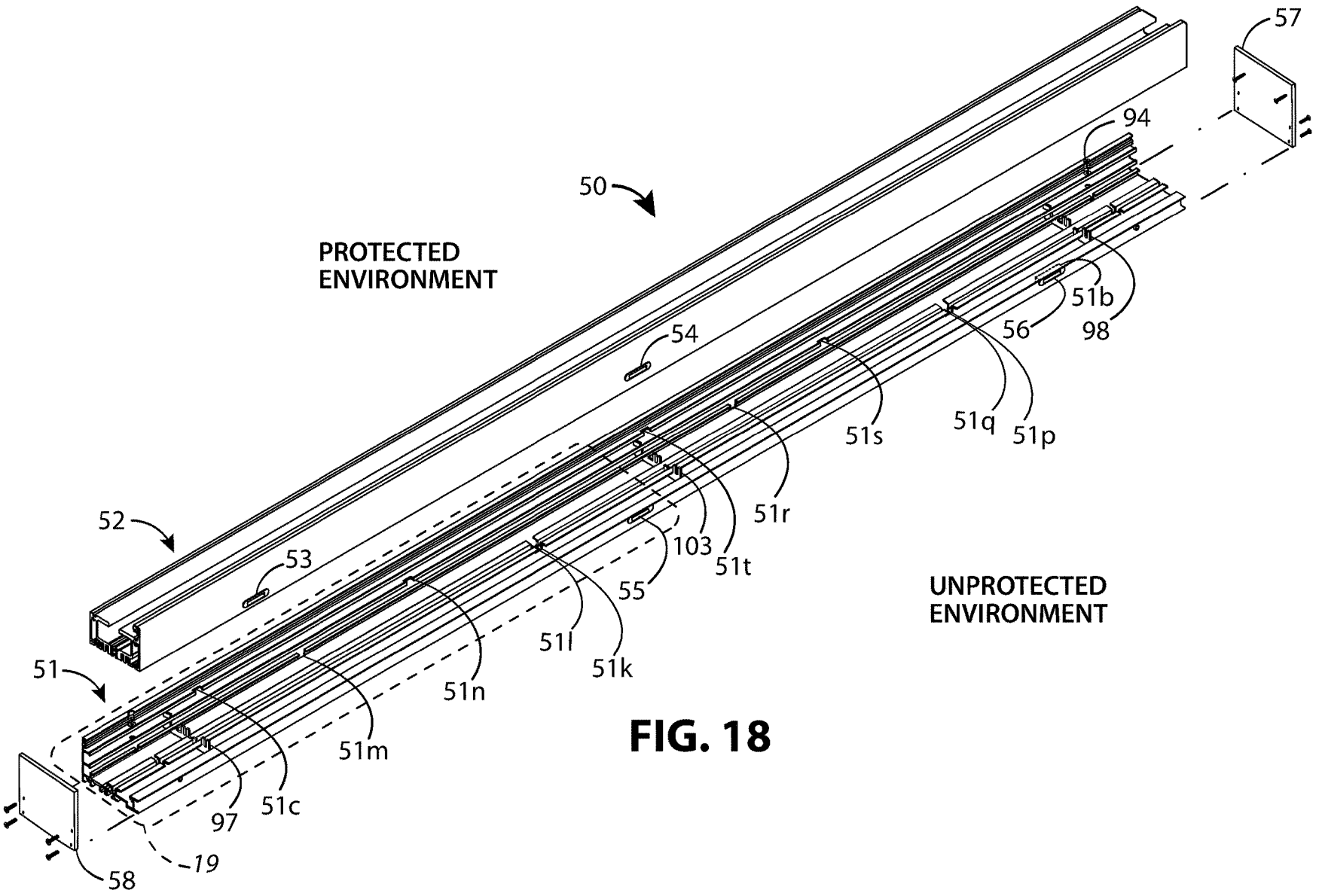
FIG. 18 illustrates a front and top perspective view of a sill assembly for a folding door with the sill and end dams exploded away from the subsill.
Figure 21:
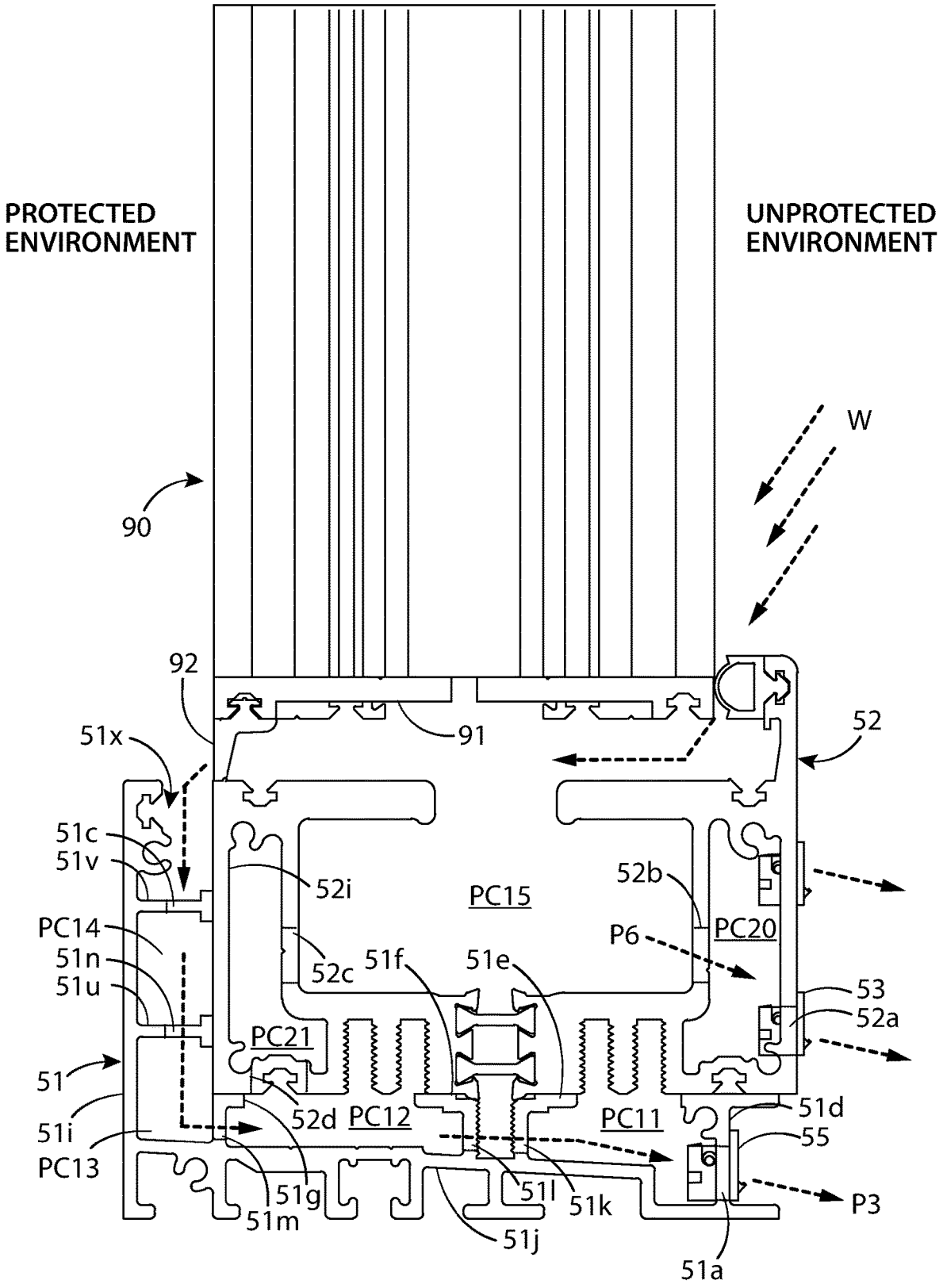
FIG. 21 illustrates a section view of FIG. 22 taken along section lines 21-21 folding door assembly illustrating a sill, and subsill, and a portion of a folding door.
Figure 22:
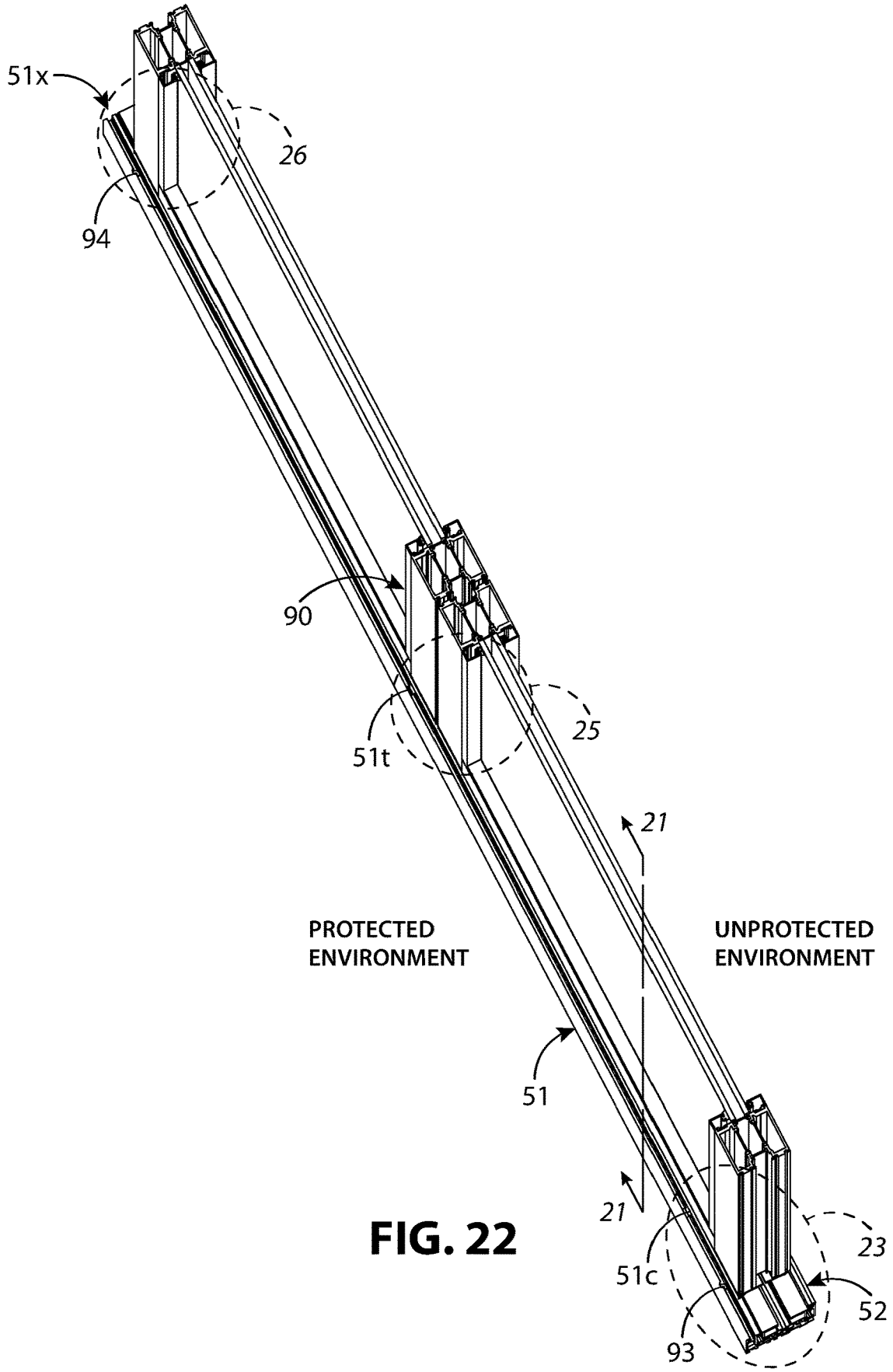
FIG. 22 illustrates a rear and top perspective view of the portion of the sill assembly and portion of the folding door of FIG. 21.

The inventor developed a sill assembly and a subsill for the sill assembly with improved resistance to air and water infiltration, several examples of which are discussed within this disclosure. The sill assembly includes a subsill that can be adapted for various sills and door types. For example, FIGS. 1, 9, and 18 illustrate the sill assemblies 30, 40, 50, respectively. FIGS. 1-8 illustrate subsill 31 and sill 32 (FIGS. 3, 4, 7, 8) adapted for swing door 70 (FIGS. 3, 4, and 8). FIGS. 9-17 illustrate subsill 41 and sill 42 (FIGS. 9 and 11-17) adapted for sliding door 80 (FIGS. 11, 12, and 17). FIGS. 18-30 illustrate the subsill 51 and sill 52 (FIGS. 18 and 21-30) adapted for folding door 90 (FIGS. 21, 22, and 30). As illustrated in FIGS. 3, 11, and 21, the subsill 31, 41, 51, is positioned at least partially below the sill 32, 42, 52, respectively. While there are differences in implementation between these examples, there are also some common principles used throughout that will be described.

FIGS. 1, 9, and 18 illustrates a front and top perspective view of sill assemblies 30, 40, 50, respectively. Typically, the subsill 31, 41, 51 and sill 32, 42, 52, of FIGS. 1, 9, and 18, respectively can be made of aluminum, steel, thermoplastic, vinyl, fiberglass, or other materials able to withstand the day-to-day operation of a sill assembly under a door or window and reasonably maintain structural integrity and water tightness. The subsill 31, 41, 51 and sill 32, 42, 52 can typically be extruded, but depending on the material, can also be cast, stamped, milled, molded, or otherwise formed.

Figure 2:
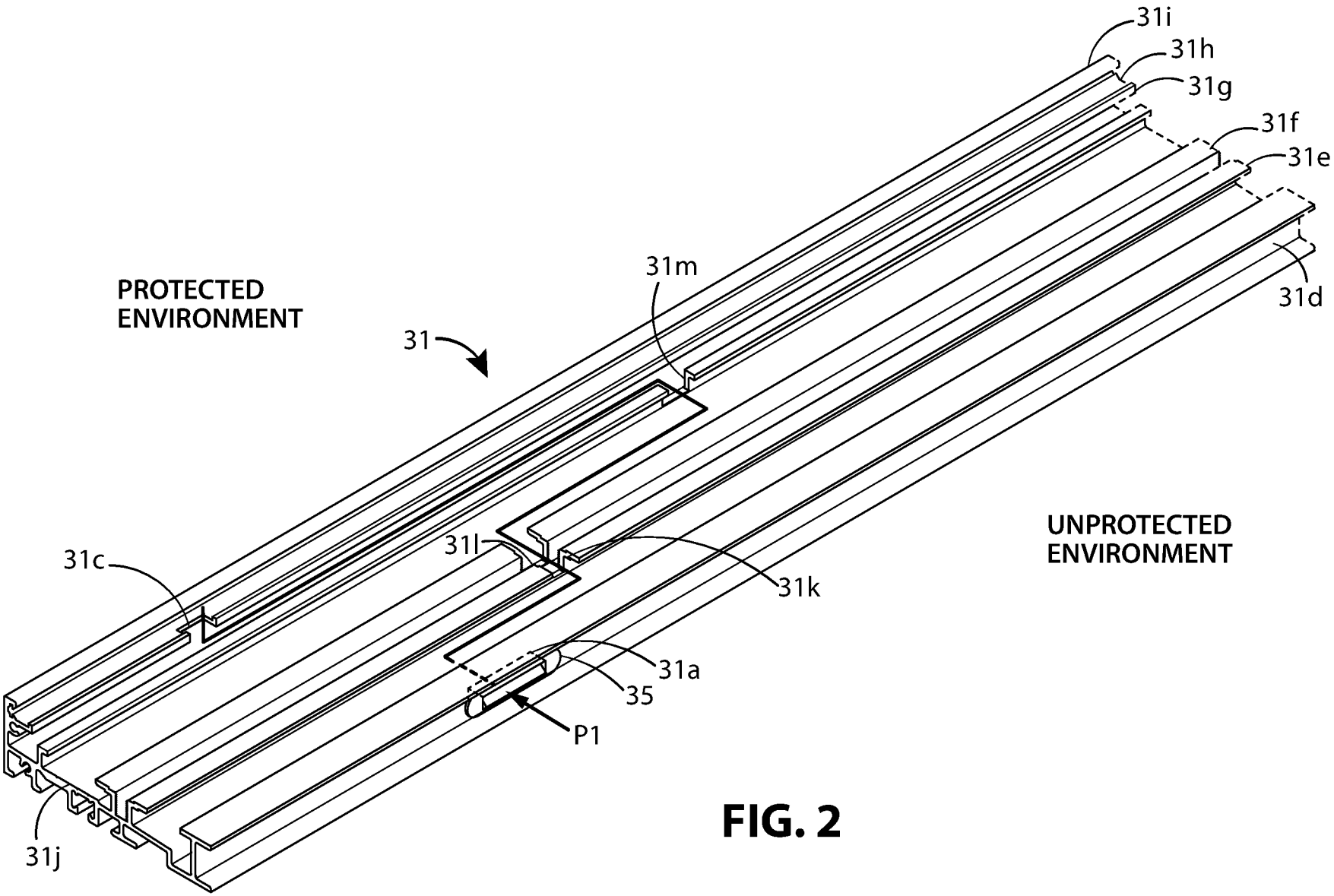
FIG. 2 illustrates an enlarged view of a portion of the subsill of FIG. 1.
Figure 10:
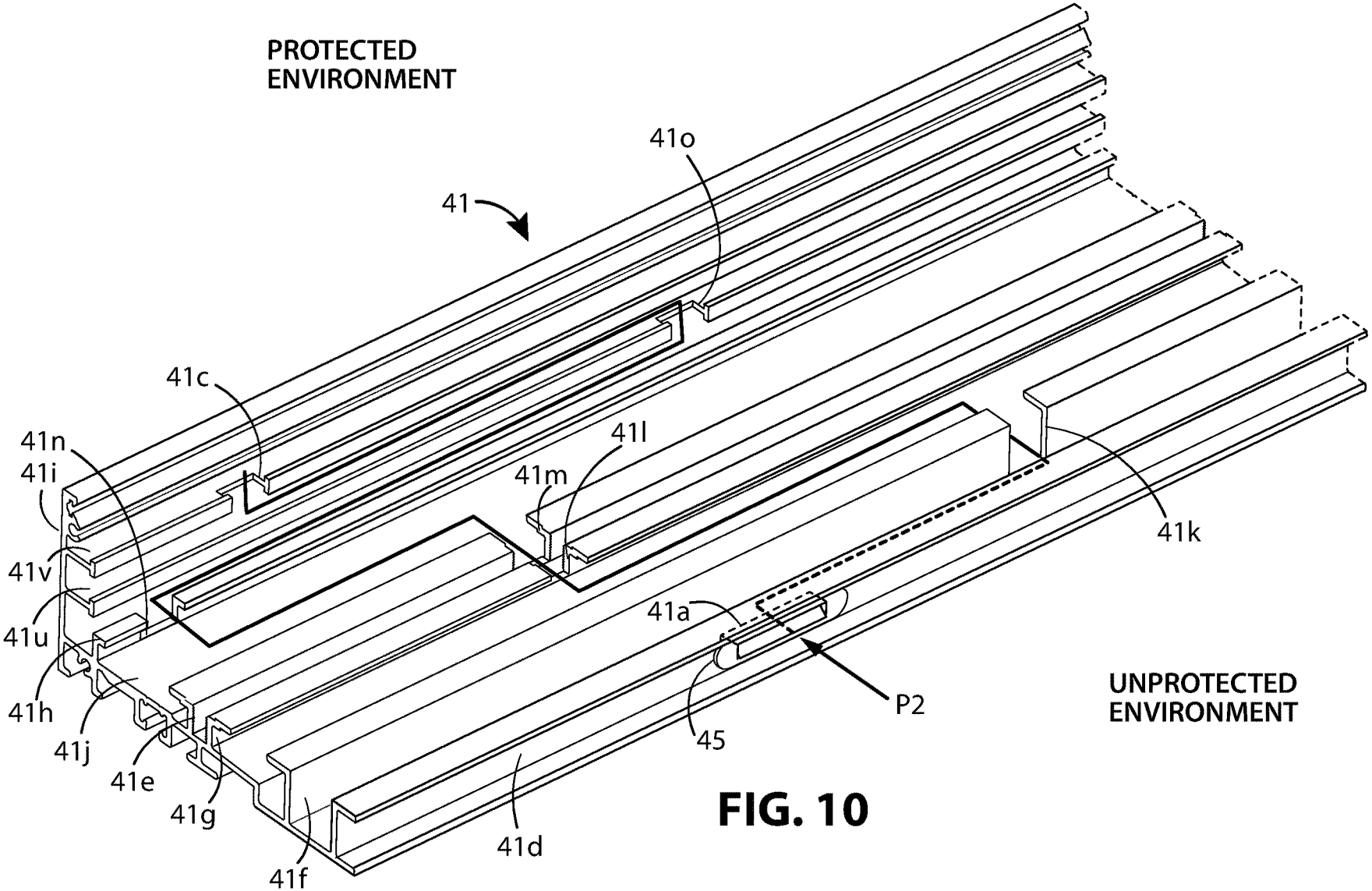
FIG. 10 illustrates an enlarged view of a portion of the subsill of FIG. 9.
Figure 19:
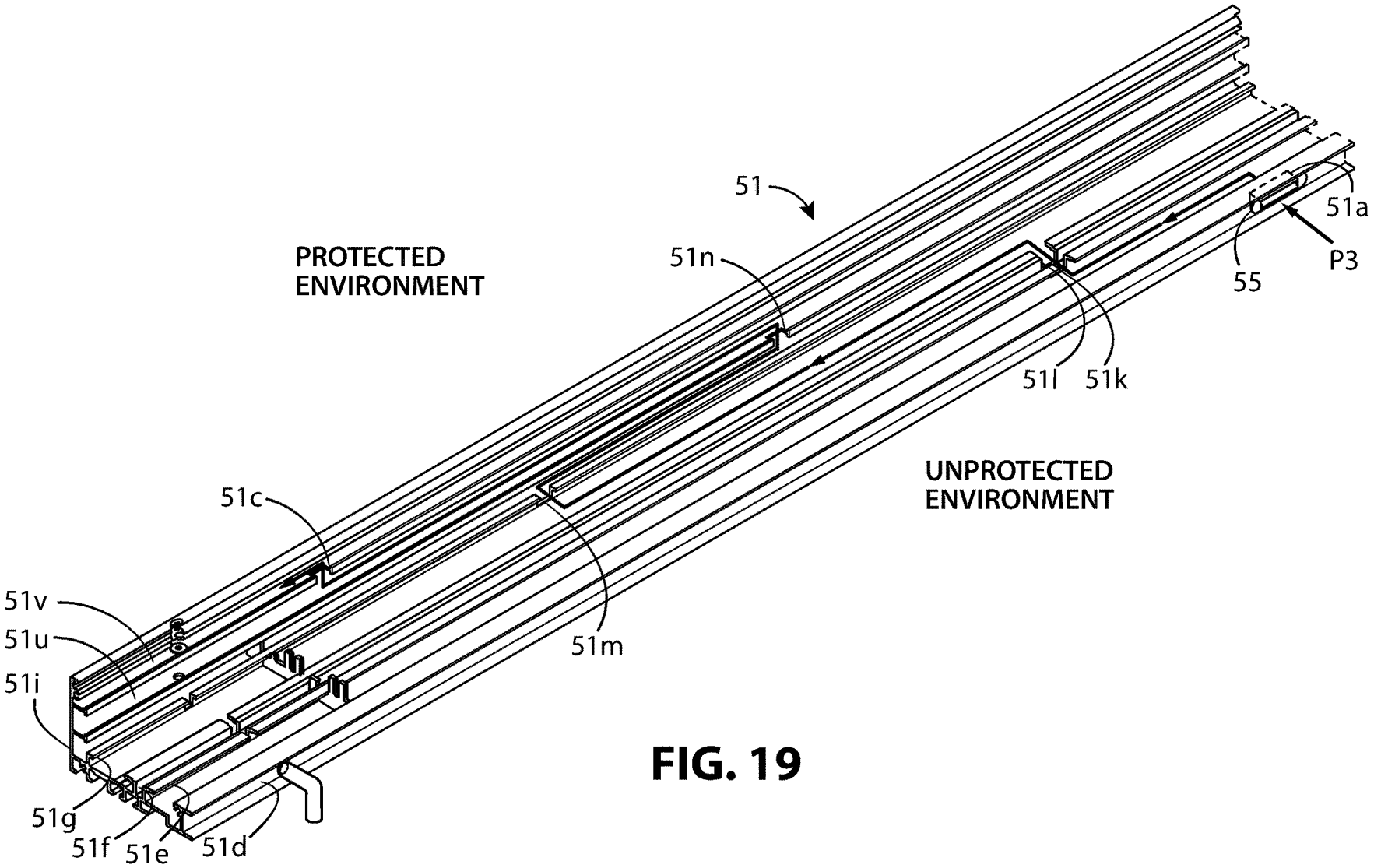
FIG. 19 illustrates an enlarged view of a portion of the subsill of FIG. 18.

Referring to FIGS. 2, 10, and 19, the subsills 31, 41, 51, respectively, have a series of cavities extending lengthwise along their respective subsills and that are structured for water and air to travel into or out of the subsills by circuitous paths rather than direct paths. The inventor discovered that this helps to create better resistance to incoming water than a sill with direct paths for water and air in part because of the longer path lengths. Paths P1, P2, P3 of FIGS. 2, 10, and 19, respectively illustrate outflowing circuitous paths. Inflowing air and water would also follow the same corresponding circuitous path.

Referring to FIGS. 3, 11, and 21, water, typically wind-driven rain, represented by water path W, can contact the swing door 70 (FIG. 3), the sliding door 80 (FIG. 11), and/or folding door 90 (FIG. 21) and can contact the sills 32, 42, 52 of FIGS. 3, 11, and 21, respectively. Water may find its way into the sills 32, 42, 52 indirectly through leaks in the door seals and/or directly when rain driven water hits the sills 32, 42, 52 while the door is open. Typically, water drains out of the sills 32, 42, 52 through one or more weep holes. For example, water may drain to the unprotected environment through water path P4 and weep hole 32*a* in FIG. 3 and by water path P6 through aperture 52*b* and weep hole 52*a* in FIG. 21. In FIG. 11, water could typically drain out through water path P5 and weep hole 42*a* in the bottom of the sill 42 and into the subsill 41 in FIG. 11. Weep holes can optionally be equipped with weep flaps to reduce water and air infiltration from the unprotected environment. For example, in FIG. 3, weep hole 32*a* can be optionally equipped with weep flap 33 and in FIG. 21, weep hole 52*a* can optionally be equipped with weep flap 53. FIGS. 1 and 8 in addition to showing weep flap 33, show a weep hole that is equipped with weep flap 34. FIGS. 18 and 30 in addition to showing weep flap 53, show a weep hole that is equipped with weep flap 54. Additional weep holes and weep flaps can be added as required depending on the drainage requirements and length of the sills.

In FIGS. 3, 11, and 21, subsills 31, 41, 51, respectively provide additional drainage paths. For example, water can drain out through weep holes 31*a*, 41*a*, 51*a* of FIGS. 3, 11, and 21, respectively. Additional weep holes can be used as needed, for example, weep hole 31*b* of FIG. 1, weep hole 41*b* of FIG. 9, and weep hole 51*b* of FIG. 18. While weep holes provide drainage paths, they also have the potential to allow water infiltration from driven water such as driving rain from windstorms. Pressure equalization within the subsill can help reduce this effect (i.e., the air pressure inside the chamber matches the outside air pressure), but this is not always possible. Optionally equipping the weep holes with weep flaps can also be used to help mitigate water infiltration through the weep holes. For example, subsill 31 of FIGS. 1 and 8 can be optionally equipped with weep flaps 35, 36. Subsill 41 of FIGS. 9 and 17 can be equipped with weep flaps 45, 46. Subsill 51 of FIGS. 18 and 30 can be equipped with weep flaps 55, 56. Weep flaps 35, 45, 55 are also shown in FIGS. 3, 11, and 21, respectively. Weep flaps can fail over time from dirt, debris, and other environmental elements and do not form a perfect seal. The inventor discovered that he could help mitigate the infiltration of water through the weep holes by forcing the water to flow within the subsill by a circuitous route rather than a straight route. By creating a circuitous route, the path length that the water is required to flow is longer. This slows down the flow of water into the system and reduces the water pressure.

FIGS. 1, 9, and 18 illustrate examples of how water can be routed in a circuitous rather than direct route through a plurality of pressure chambers formed between the subsill and sill. The pressure chambers extend lengthwise along the subsill. Pressure chambers can extend back to front, i.e., one behind another. Pressure chambers can also extend up to down, i.e., one on top of the other. For example, in FIG. 3, pressure chambers PC1, PC2, PC3 extend one behind another. Pressure chamber PC1 is illustrated with weep hole 31*a* into the unprotected environment. Pressure chamber PC3 includes aperture 31*c* into the protected environment. In FIG. 11, pressure chambers PC5, PC6, PC7, PC8 extend one behind another. Pressure chambers PC8 and PC9 extend one on top of the other. Pressure chamber PC5 is illustrated with weep hole 41*a* and optionally, the weep flap 45 into the unprotected environment. Pressure chamber PC9 includes aperture 41*c* extending into the protected environment. The pressure chamber can be formed between walls or barriers projecting upward from the bottom of the subsill and bound on the top by the sill. In FIG. 21, pressure chamber PC11, PC12, PC13 are arranged one behind another. Pressure chamber PC13, PC14 are arranged one above the other. Pressure chamber PC11 is illustrated with weep hole 51*a* and optionally, the weep flap 55, extending into the unprotected environment. Pressure chamber PC14 includes aperture 51*c* extending into the protected environment.

FIGS. 2, 10, and 19 show enlarged portions of FIGS. 1, 9, and 18, respectively. Water is shown restricted to flow through circuitous paths either into or out of the system, for example, the paths P1, P2, P3 of FIGS. 2, 10, and 19 respectively. Referring to FIG. 2, water, for example from wind-driven rain, might find its way into weep flap 35 and through weep hole 31*a*, for example, because of dirt, debris, or imperfect sealing of the weep flap 35. Similarly, in FIG. 10 water might find its way through the weep flap 45 and weep hole 41*a*, or in FIG. 19, through the weep flap 55 and weep hole 51*a*. In FIGS. 2, 10, and 19 the water is restricted to flow in circuitous path by apertures in the pressure chamber walls.

Referring to FIGS. 3, 11, and 21, pressure chambers are formed between partitions or between partitions and subsill walls. The partitions extend lengthwise and project upward from the subsills 31, 41, 51 and engage portions of the sill 32, 42, 52, respectively and create enclosed chambers with air and water flow restricted by apertures.

In FIG. 3, the subsill front wall 31*d* and partition 31*f* engage the sill 32 to form pressure chamber PC1. Partition 31*f* and partition 31*g* engage the sill 32 to form pressure chamber PC2. Partition 31*g*, the subsill back wall 31*i*, partition 31*h*, the sill back wall 32*i*, and subsill bottom wall 31*j* together form the pressure chamber PC3. Partition 31*h* projects inward from the subsill back wall 31*i* toward the sill back wall 32*i*. Partition 31*e* does not form part of the pressure chamber wall. The partitions 31*e*, 31*f* can be grooved to accept a threaded fastener to attach the sill 32. FIG. 7 illustrates a cutaway detail the sill 32 and the subsill 31. Partition 31*f* engaging the sill 32. Partition 31*h* projects inward from subsill back wall 31*i* and engages the sill back wall 32*i*. FIG. 7 also illustrates the sill back wall 32*i* in relation to aperture 31*c*. Subsill front wall 31*d*, partitions 31*e*, 31*f*, 31*g*, 31*h*, subsill back wall 31*i*, and the subsill bottom wall 31*j* are also illustrated in FIG. 2. Referring to FIGS. 2 and 3, the weep hole 31*a* in the subsill front wall 31*d* and the apertures 31*k*, 31*l*, 31*m*, 31*c* in the partitions 31*e*, 31*f*, 31*g*, 31*h*, respectively, are arranged so the water can either travel into or drain out of the subsill 31 by a circuitous route. In this example, the water and air can flow either inward or outward through path P1.

Figure 15:
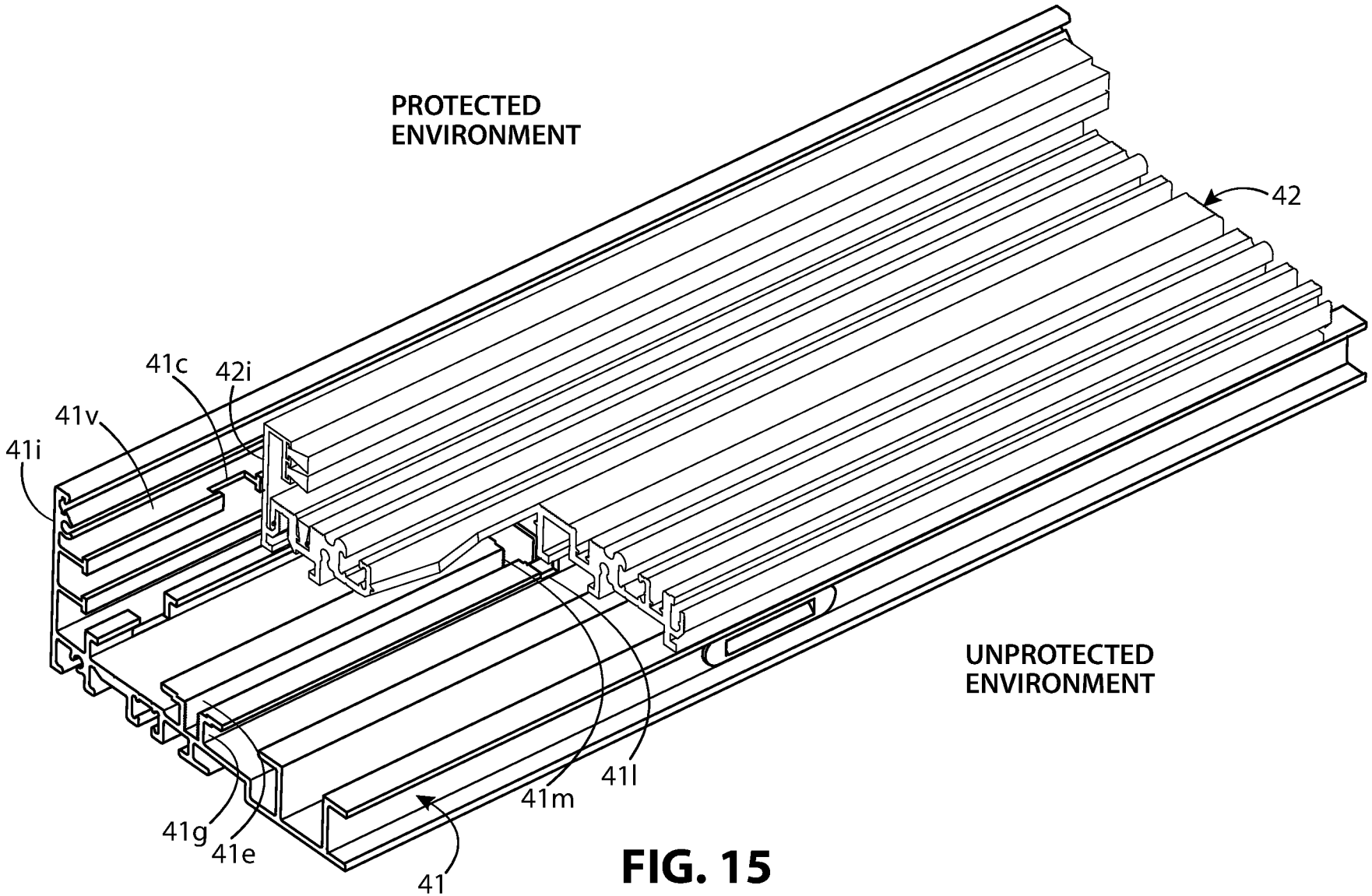
FIG. 15 illustrates a right-side portion, in perspective view, of the sill assembly of FIG. 9 with a portion of the sill cutaway to show the first upper drain aperture and an interior aperture.

Similar to what was described for FIG. 3, in FIG. 11, the subsill front wall 41*d* and partition 41*f* engage the sill 42 to form pressure chamber PC5. Partition 41*f* and partition 41*g* engage the sill 42 to form pressure chamber PC6. Partition 41*g* and partition 41*h* together with the sill 42 form pressure chamber PC7. The subsill back wall 41*i*, partition 41*h*, the sill back wall 42*i*, partition 41*u*, and subsill bottom wall 41*j*, together form the pressure chamber PC8. Partition 41*u* projects inward from the subsill back wall 41*i* toward the sill back wall 42*i*. Partition 41*u*, 41*v*, subsill back wall 41*i*, and sill back wall 42*i* form pressure chamber PC9. Partition 41*v* projects inward from the subsill back wall 41*i* toward the sill back wall 42*i*. Partition 41*e* as illustrated, does not form part of a pressure chamber wall. Partition 41*e* and partition 41*g* can be grooved to accept a threaded fastener between them to attach the sill 42 to the subsill 41. FIG. 15 shows a cutaway detail of the sill 42 cut away from the subsill 41. FIG. 15 illustrates partition 41*g* and aperture 41*l* engaging the sill 42. Partition 41*v* projects inward from the subsill back wall 41*i* and engaging the sill back wall 42*i*. FIG. 15 also illustrates the sill back wall 42*i* in relation to the aperture 41*c*. Partition 41*e* and aperture 41*m* is illustrated in relation to the sill 42.

Figure 16:
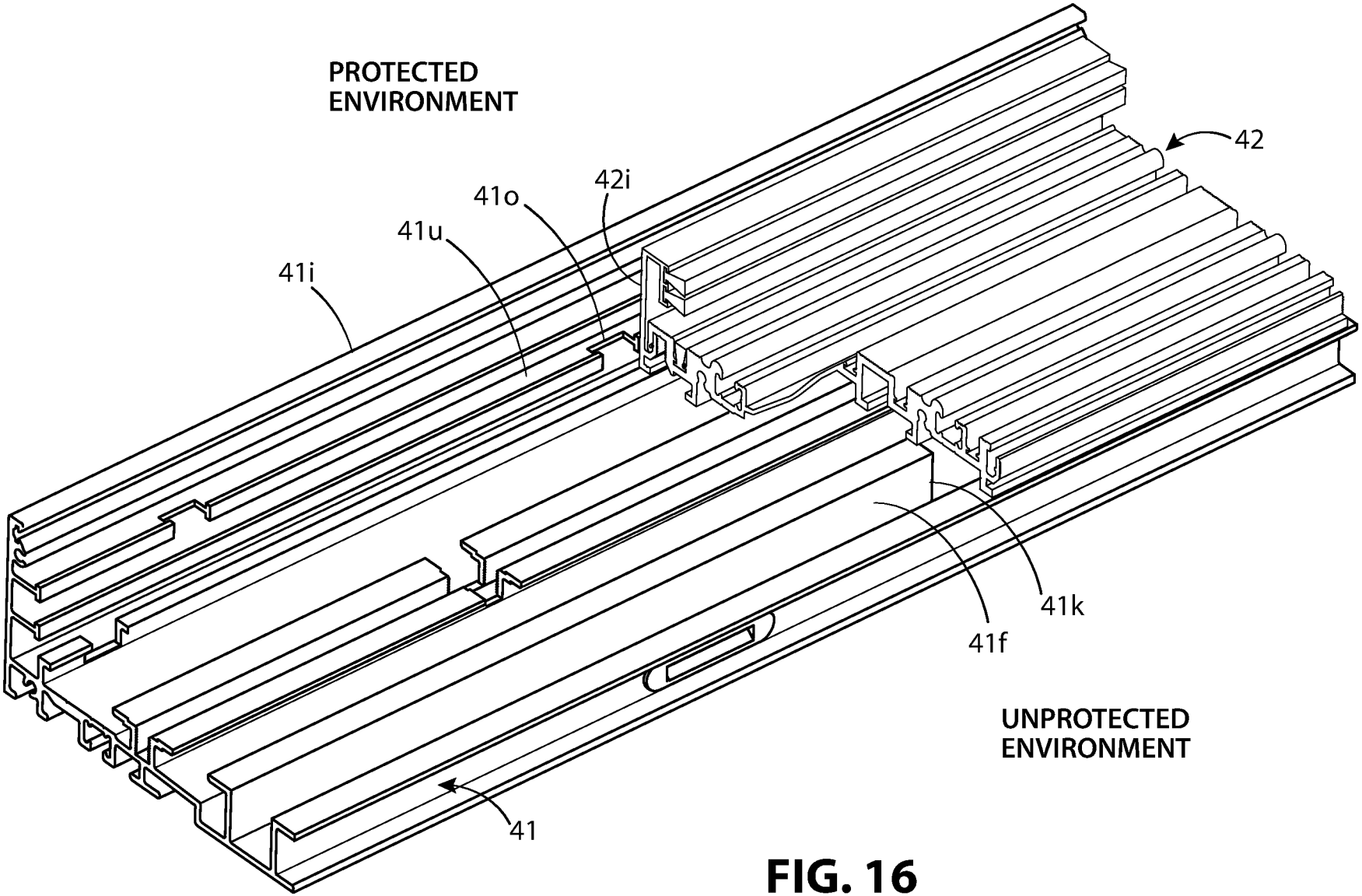
FIG. 16 illustrates a portion, in perspective view, of the sill assembly of FIG. 9 with a portion of the sill cutaway to show the first lower drain aperture and an interior aperture.

FIG. 16 shows a cutaway detail of the sill 42 cut away from the subsill 41. FIG. 16 illustrates partition 41*f* and aperture 41*k* engaging the sill 42, the partition 41*u* projecting inward from subsill back wall 41*i* and engaging the sill back wall 42*i*. The sill back wall 42*i* is also shown in relation to the aperture 41*o*. FIG. 10 also illustrates subsill front wall 41*d*, partitions 41*e*, 41*f*, 41*g*, 41*h*, 41*u*, 41*v*, and subsill back wall 41*i*. Referring to FIGS. 10 and 11, the weep hole 41*a* in the subsill front wall 41*d* and the apertures 41*k*, 41*l*, 41*m*, 41*n*, 41*o*, 41*c* in the partitions 41*f*, 41*g*, 41*e*, 41*h*, 41*u*, 41*v*, respectively, are arranged so the water can either travel into or drain out of the subsill 41 by a circuitous route. In this example water and air can flow either inward or outward through path P2.

Similar to what was described for FIGS. 3 and 11, in FIG. 21, the subsill front wall 51*d* and partition 51*e* engage the sill 52 to form pressure chamber PC11. Partition 51*f* and partition 51*g* engage the sill 52 to form pressure chamber PC12. The subsill back wall 51*i*, partition 51*g*, the sill back wall 52*i*, partition 51*u*, and subsill bottom wall 51*j*, together form the pressure chamber PC13. Partition 51*u* projects inward from the subsill back wall 51*i* toward the sill back wall 52*i*. Partition 51*u*, 51*v*, the subsill back wall 51*i*, and the sill back wall 52*i* form pressure chamber PC14. Partition 51*v* projects inward from the subsill back wall 51*i* toward the sill back wall 52*i*. Partition 51*e* and partition 51*f* can be grooved to accept a threaded fastener between them to attach the sill 52 to the subsill 51.

Figure 28:
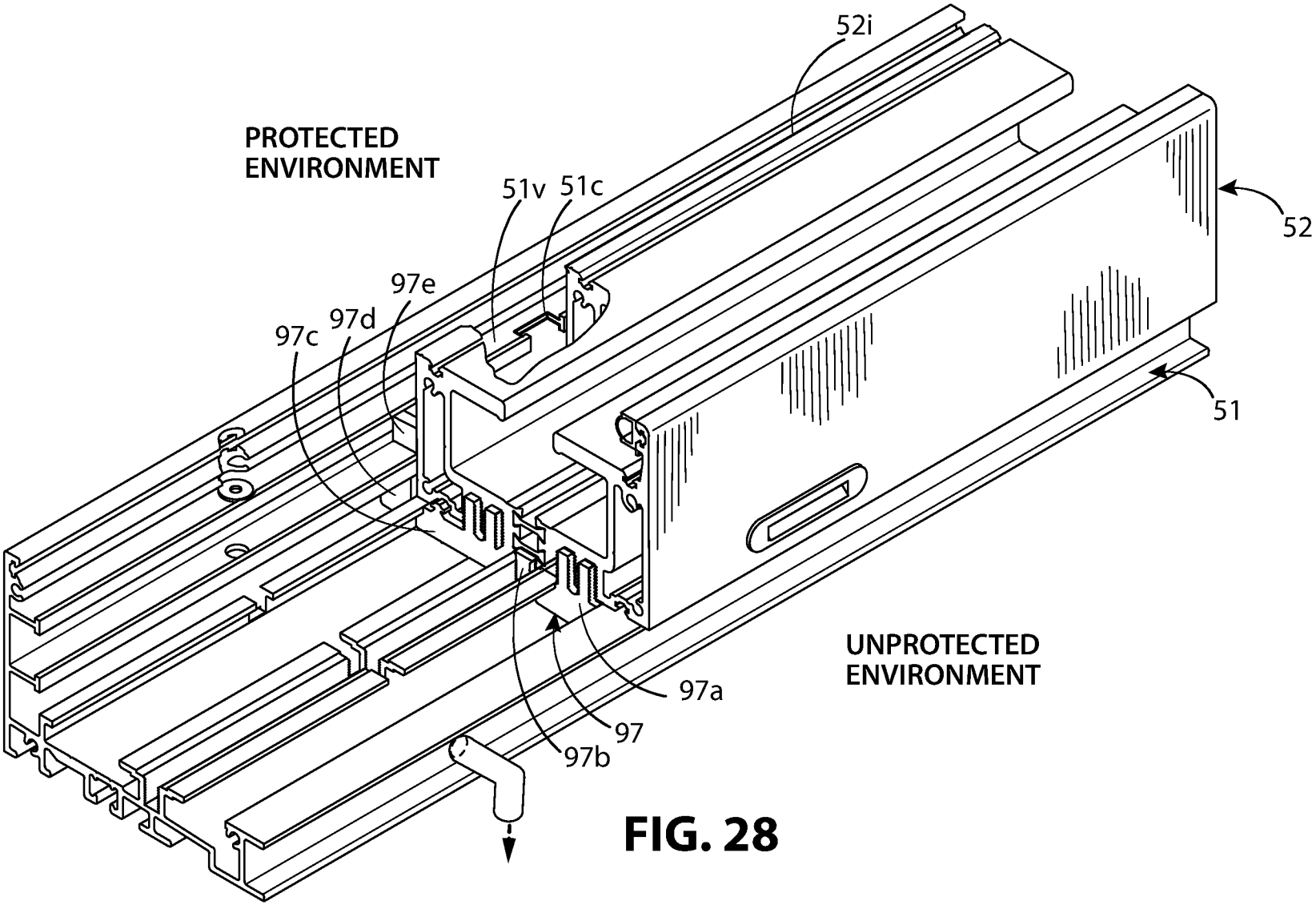
FIG. 28 illustrates a left-side portion, in perspective view, of the sill assembly of FIG. 18 with a portion of the sill cutaway to show details of an overflow chamber.
Figure 29:
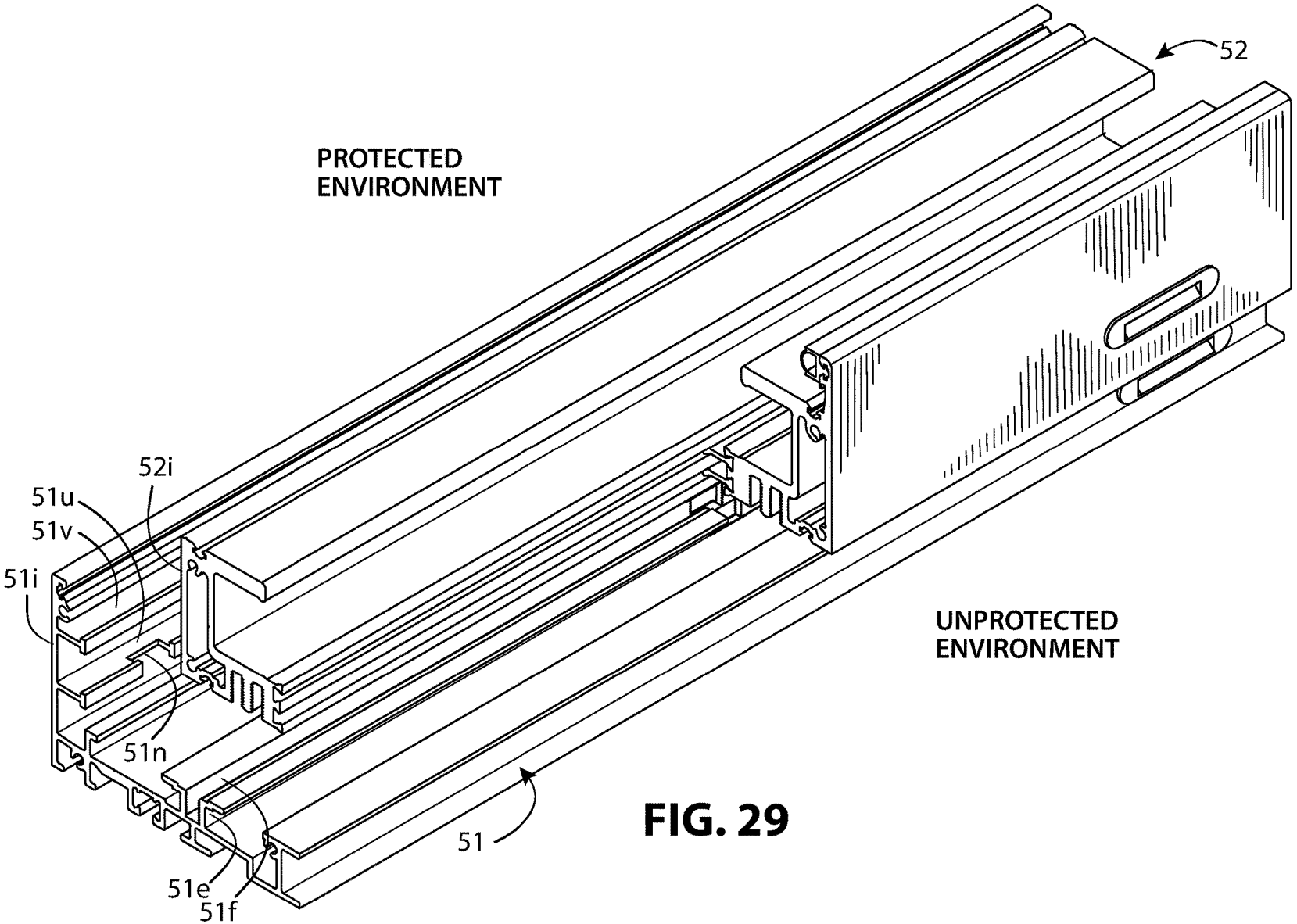
FIG. 29 illustrates a portion, in perspective view, of the sill assembly of FIG. 18 with a portion of the sill cutaway to show details of how drain apertures in the subsill interface with drain apertures in the sill.
Figure 30:
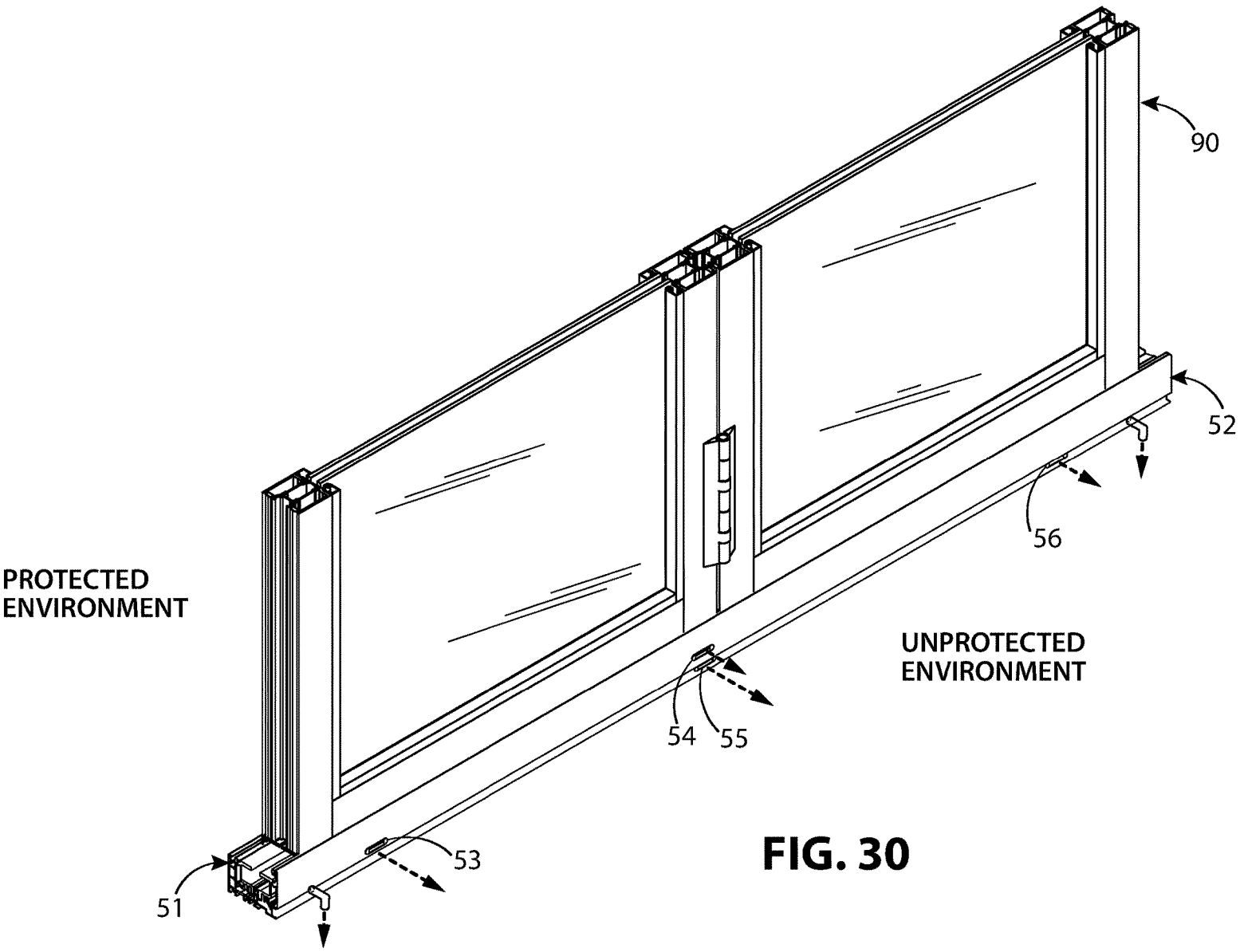
FIG. 30 illustrates a front perspective view the sill assembly and folding door portion of FIG. 22 showing the water drain path to the unprotected environment.

FIG. 29 shows a cutaway detail of sill 52 cut away from subsill 51. FIG. 29 illustrates partitions 51*e*, 51*f* engaging the sill 52. FIG. 29 also illustrates partitions 51*u*, 51*v* projecting inward from the subsill back wall 51*i* and engaging the sill back wall 52*i*. Also illustrated is the sill back wall 52*i* in relation to the aperture 51*n*. FIG. 28 also illustrates the relationship between aperture 51*c*, partition 51*v*, and the sill back wall 52*i*. The subsill front wall 51*d*, the partitions 51*e*, 51*f*, 51*g*, 51*u*, 51*v*, and the subsill back wall 51*i* are also illustrated in FIG. 19. Referring to FIGS. 19 and 21, the weep hole 51*a* in the subsill front wall 51*d* and the apertures 51*k*, 51*l*, 51*m*, 51*n*, 51*c* in the partitions 51*e*, 51*f*, 51*g*, 51*u*, 51*v*, respectively, are arranged so the water can either travel into or drain out of the subsill 51 by a circuitous route. In this example, the water and air can flow either inward or outward through path P3.

Figure 20:
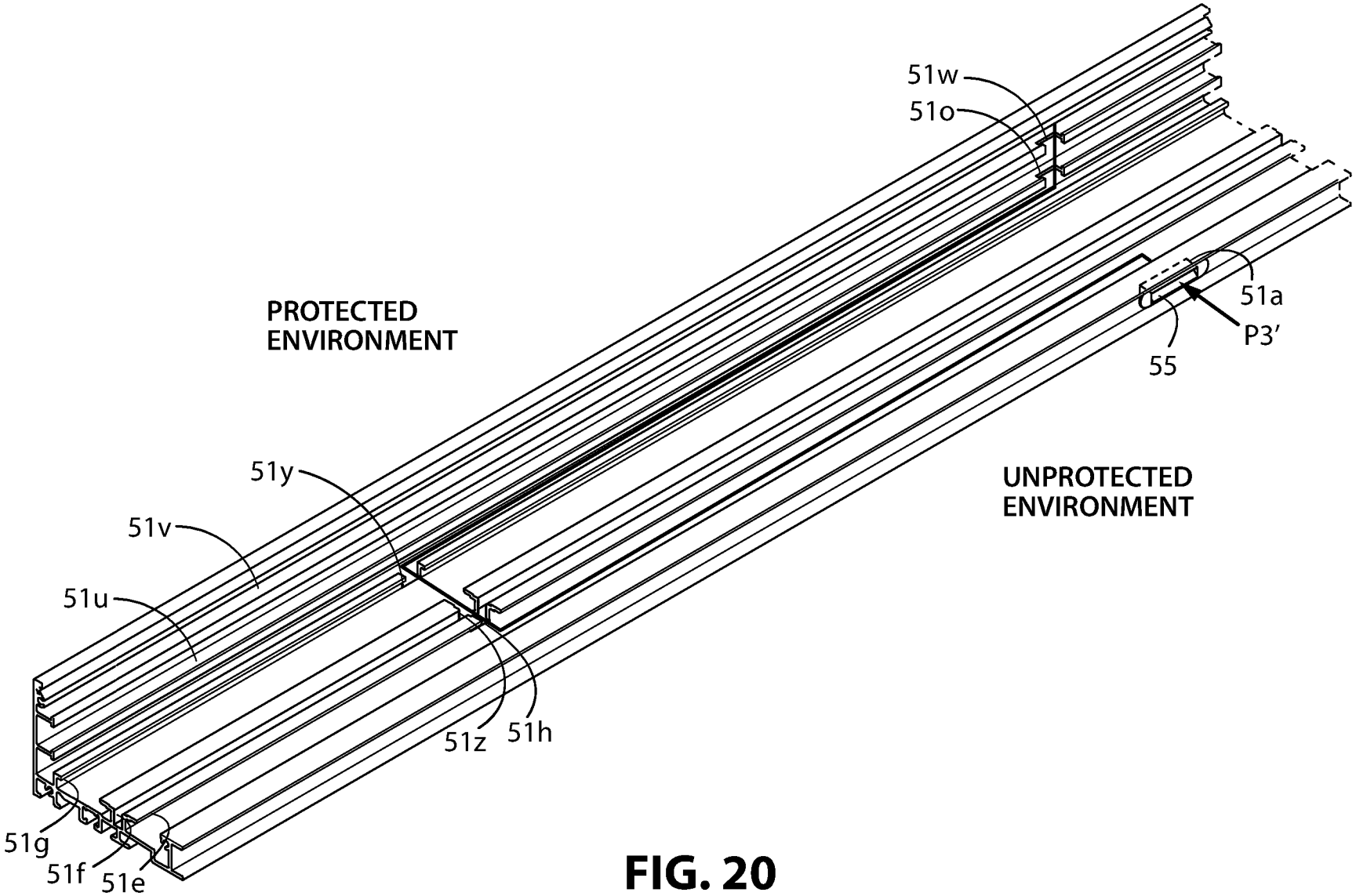
FIG. 20 illustrates an enlarged view of a portion of the subsill of FIG. 18 with an alternative arrangement of openings in the partitions as compared with FIG. 19.

FIG. 20 illustrates an example of an alternative arrangement of apertures where the circuitous route occurs between the pressure chambers stacked one above another and the pressure chambers stacked one in front of the other. In FIG. 20, water is routed through apertures 51*w*, 51*o*, 51*y*, 51*z*, 51*h* in partitions 51*v*, 51*u*, 51*g*, 51*f*, 51*e*, respectively and through weep hole 51*a* and optionally through weep flap 55 along path P3'. Apertures 51*w*, 510 are shown parallel to each. Apertures 51*y*, 51*z*, 51*h* are also shown parallel to each other. Apertures 51*w*, 510 are offset from apertures 51*y*, 51*z*, 51*h*.

Referring to FIGS. 1, 9, and 18, the pressure chambers, are also enclosed on the sides. Referring to FIG. 1, end dams 37, 38 can be used to enclose the right and left sides (i.e., the lengthwise sides) of the sill assembly 30 and enclosed the sides of the pressure chambers PC1, PC2, PC3 of FIG. 3. Referring to FIG. 9, end dams 47, 48 can be used to enclose the right and left sides of the sill assembly 40 and enclose the sides of the pressure chambers PC5, PC6, PC7, PC8, PC9 of FIG. 11. Referring to FIG. 18, end dams 57, 58 can be used to enclose the right and left sides of the sill assembly 50. Referring to FIGS. 1, 9, and 18, the end dams 37, 38, 47, 48, 57, 58 can be attached to their respective sills and subsills by threaded fasteners, non-threaded fasteners (such as pins), adhesive, silicone, sealant, welding, and/or other methods or combinations that create a water-tight and air-tight seal. The end dams 37, 38 of FIG. 1, end dams 47, 48 of FIG. 9, and end dams 57, 58 of FIG. 18 can be attached to sill assemblies 30, 40, 50, respectively, before installing the sill assemblies between door or window jams. A portion of the end dams 37, 38, 47, 48, 57, 58 can extend upward from the sill assemblies 30, 40, 50 and be fastened to the door or window jams by threaded fasteners, non-threaded fasteners (such as pins), silicone, adhesive, sealant, welding, and/or any other structure, method, or combination for fastening end dams to jambs that allows the end dams 37, 38, 47, 48, 57, 58 to remain fixed to the jambs and to sill assemblies 30, 40, 50 and remain reasonably air and water tight during normal day-day operations and environmental conditions.

Referring to FIGS. 3, 11, and 21, if the rate of water flow is greater than the capacity of the pressure chamber or reservoir formed between the door and the sill to drain, excess water may pass through the seal behind the door. A trough, formed between the back of the sill and subsill is used to capture the excess water and drain it out of the subsill.

In FIG. 3, excess water can flow from pressure chamber PC4 through the door seal 72 into trough 31*x*. The pressure chamber PC4 is shown formed between the frame bottom 71*a* of door frame 71 of the swing door 70 and the sill 32. The trough 31*x* is formed between the subsill back wall 31*i* and the sill back wall 32*i* and forming the top wall of pressure chamber PC3. Referring to FIG. 4, water in trough 31*x* drains into the subsill 31 through apertures 31*c*, 31*p* and can flow through the subsill 31 via a circuitous route as previously described. The trough 31*x* can extend lengthwise between the subsill 31 and the sill 32.

Figure 5:
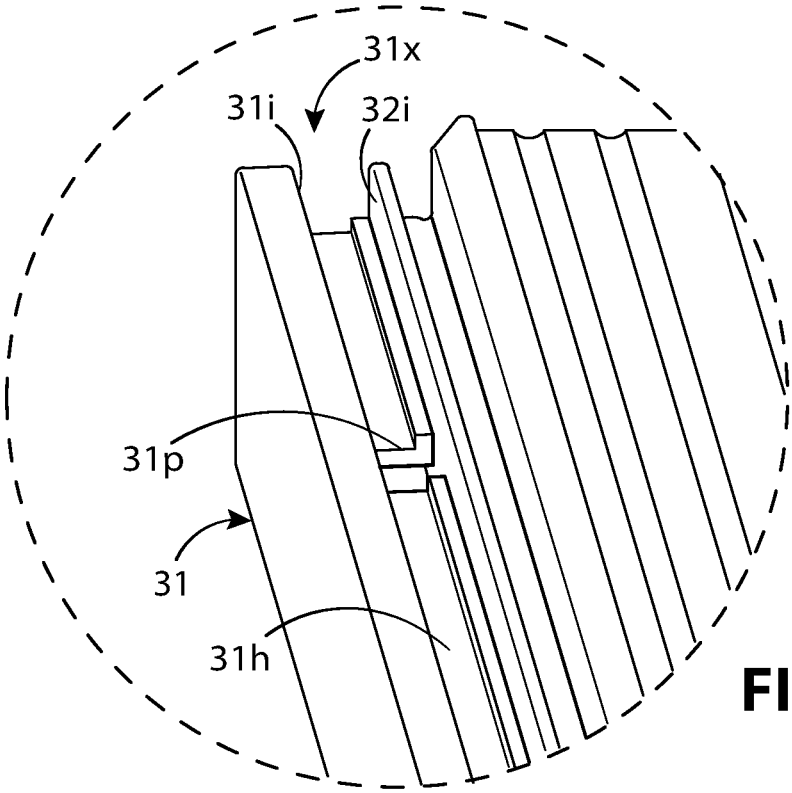
FIG. 5 illustrates a left and rear portion of FIG. 4 enlarged to illustrate details of the rear drain channel and a second upper drain aperture.
Figure 6:
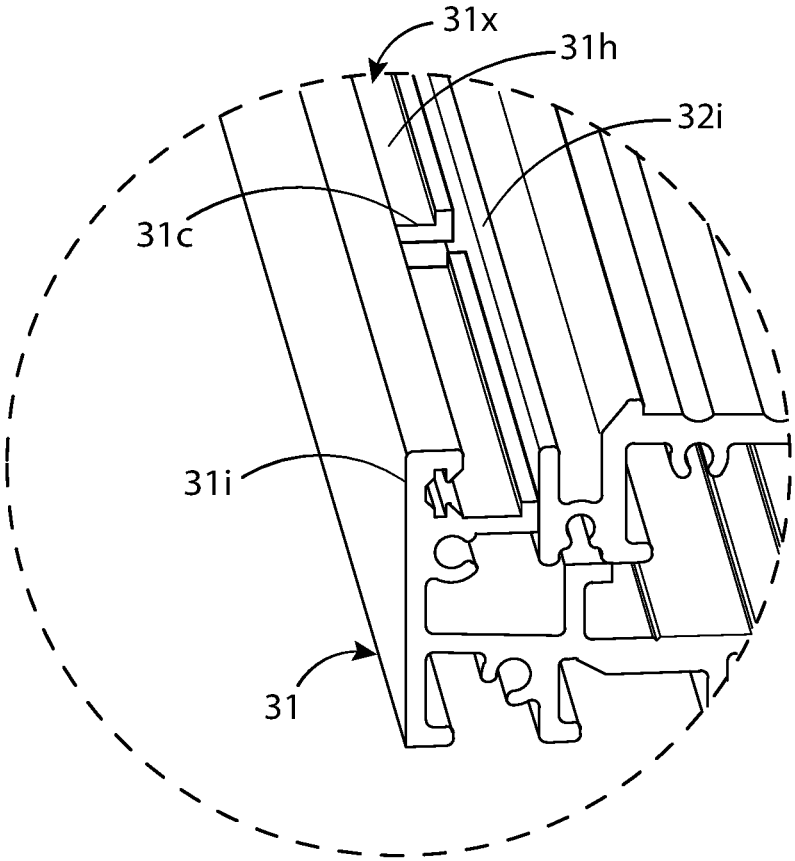
FIG. 6 illustrates a right and rear portion of FIG. 4 enlarged to illustrate details of the rear drain channel and a first upper drain aperture.

FIGS. 5 and 6 illustrate enlarged portions of FIG. 4 showing portions of the trough 31*x* in detail. Referring to FIGS. 5 and 6, trough 31*x* can be formed between the subsill back wall 31*i* and the sill back wall 32*i* with the partition 31*h* as the bottom of the trough. Referring to FIG. 3, the partition 31*h* is shown forming the top wall of pressure chamber PC3. Aperture 31*p* is illustrated in FIG. 5. Aperture 31*c* is illustrated in FIG. 6. Referring to FIGS. 5 and 6, the apertures 31*c*, 31*p* can be notched, milled, punched, or otherwise cut out. Apertures 31*p*, 31*c* of FIGS. 5 and 6, respectively is enclosed on three sides by partition 31*h* and enclosed on one side by the sill back wall 32*i*. The partition 31*h* can include an end portion that extends upward as illustrated, or can extend downward or both upward and downward. The end portions provide greater surface area against the sill back wall 32*i* and to help create a better seal. A gasket, silicone, and/or other water-tight sealants at the junction between the partition 31*h* and the sill back wall 32*i* can help create a good seal and facilitate the function of the pressure chamber PC3 of FIG. 3. While two openings are illustrated, one or more openings can be used depending on the length of the sill, the volume of pressure chamber PC3, and drainage requirements.

In FIG. 11, excess water can flow from pressure chamber PC10 through the door seal 82 and into trough 41*x*. The pressure chamber PC10 is shown formed between the door frame 81 of the sliding door 80 and the sill 42. Referring to FIG. 12, water in trough 41*x* drains into the subsill 41 through apertures 41*c*, 41*w* and can flow through the subsill 41 via a circuitous route as previously described.

Figure 13:
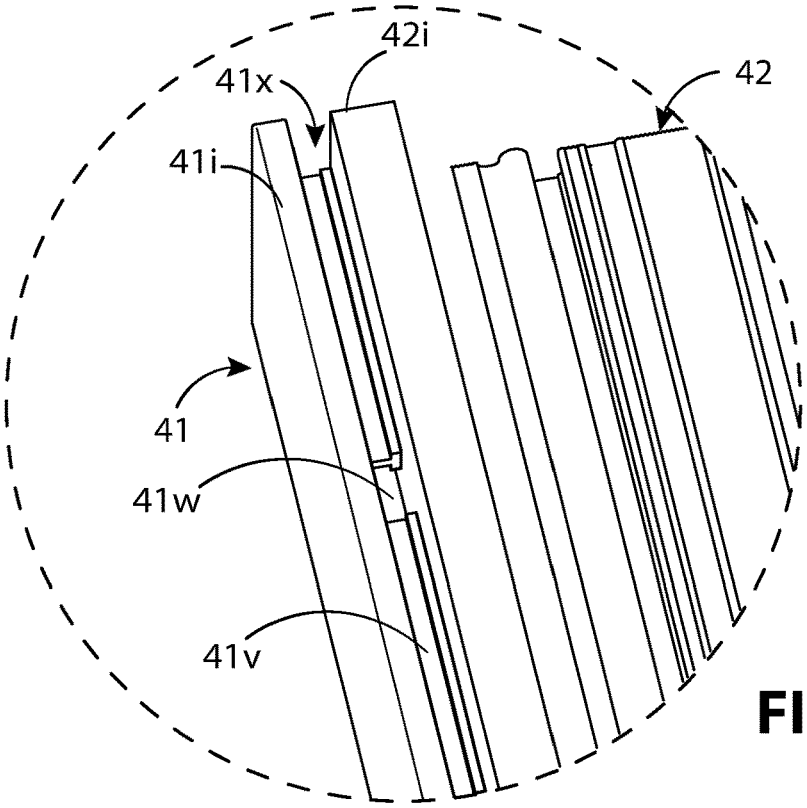
FIG. 13 illustrates a left and rear portion of FIG. 12 enlarged to illustrate details of the rear drain channel and a second upper drain aperture.
Figure 14:
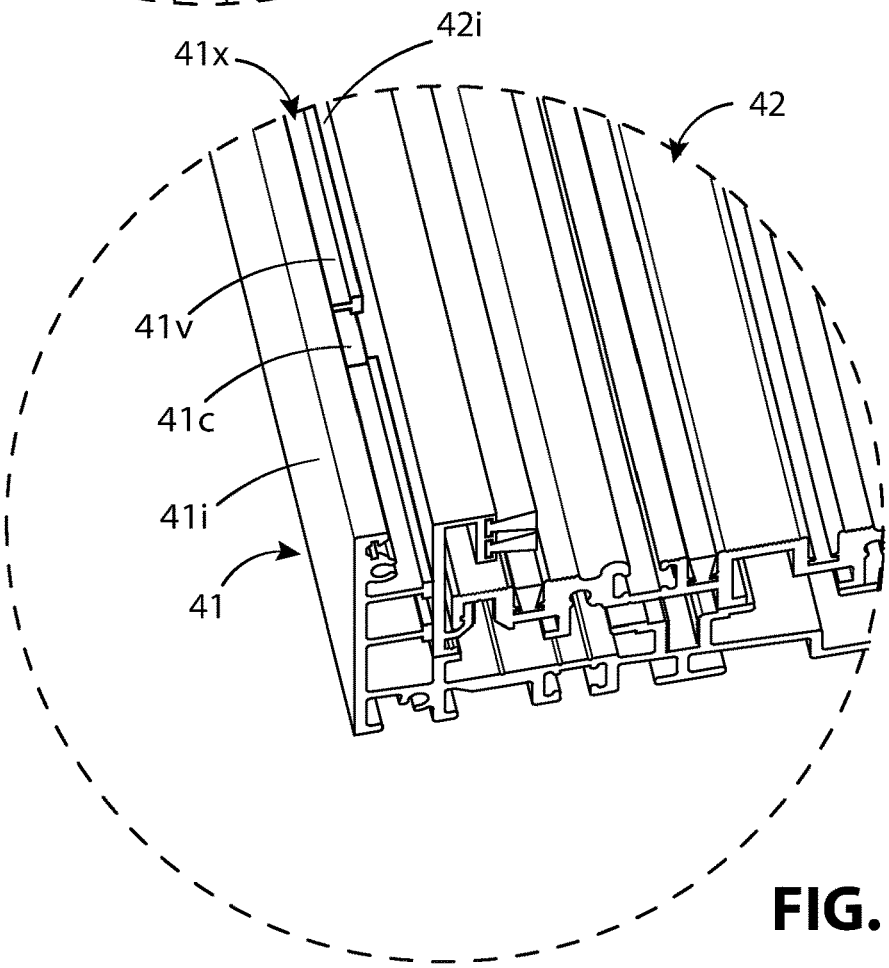
FIG. 14 illustrates a right and rear portion of FIG. 12 enlarged to illustrate details of the rear drain channel and a first upper drain aperture.

FIGS. 13 and 14 illustrate enlarged portions of FIG. 12 showing portions of the trough 41*x* in detail. Referring to FIGS. 13 and 14, trough 41*x* can be formed between the subsill back wall 41*i* and the sill back wall 42*i* with the partition 41*v* as the bottom of the trough. Referring to FIG. 11, partition 41*v* is illustrated as forming the top wall of pressure chamber PC9. Aperture 41*w* is illustrated in FIG. 13. Aperture 41*c* is illustrated in FIG. 14. The apertures 41*w*, 41*c* of FIGS. 13 and 14, respectively, can be notched, milled, punched, or otherwise cut out. Apertures 41*w*, 41*c* is enclosed on three sides by partition 41*v* and enclosed on one side by the sill back wall 42*i*. The partition 41*v* can include an end portion that extends upward as illustrated, or can extend downward or both upward and downward. The end portions provide greater surface area against the sill back wall 42*i* and help create a better seal. A gasket, silicone, and/or other water-tight sealants at the junction between the partition 41*v* and the sill back wall 42*i* can help create a good seal and facilitate the function of the pressure chamber PC9 of FIG. 11. While two openings are illustrated, one or more openings can be used depending on the length of the sill, the volume of pressure chamber PC9, and drainage requirements.

In FIG. 21, excess water can flow from pressure chamber PC15 through the door seal 92 and into trough 51*x*. The pressure chamber PC15 is shown formed between the door frame 91 of the folding door 90 and the sill 52. Referring to FIG. 22, water in trough 51*x* drains into the subsill 51 through apertures 51*c*, 51*t* and can flow through the subsill 51 via a circuitous route as previously described.

Figure 23:
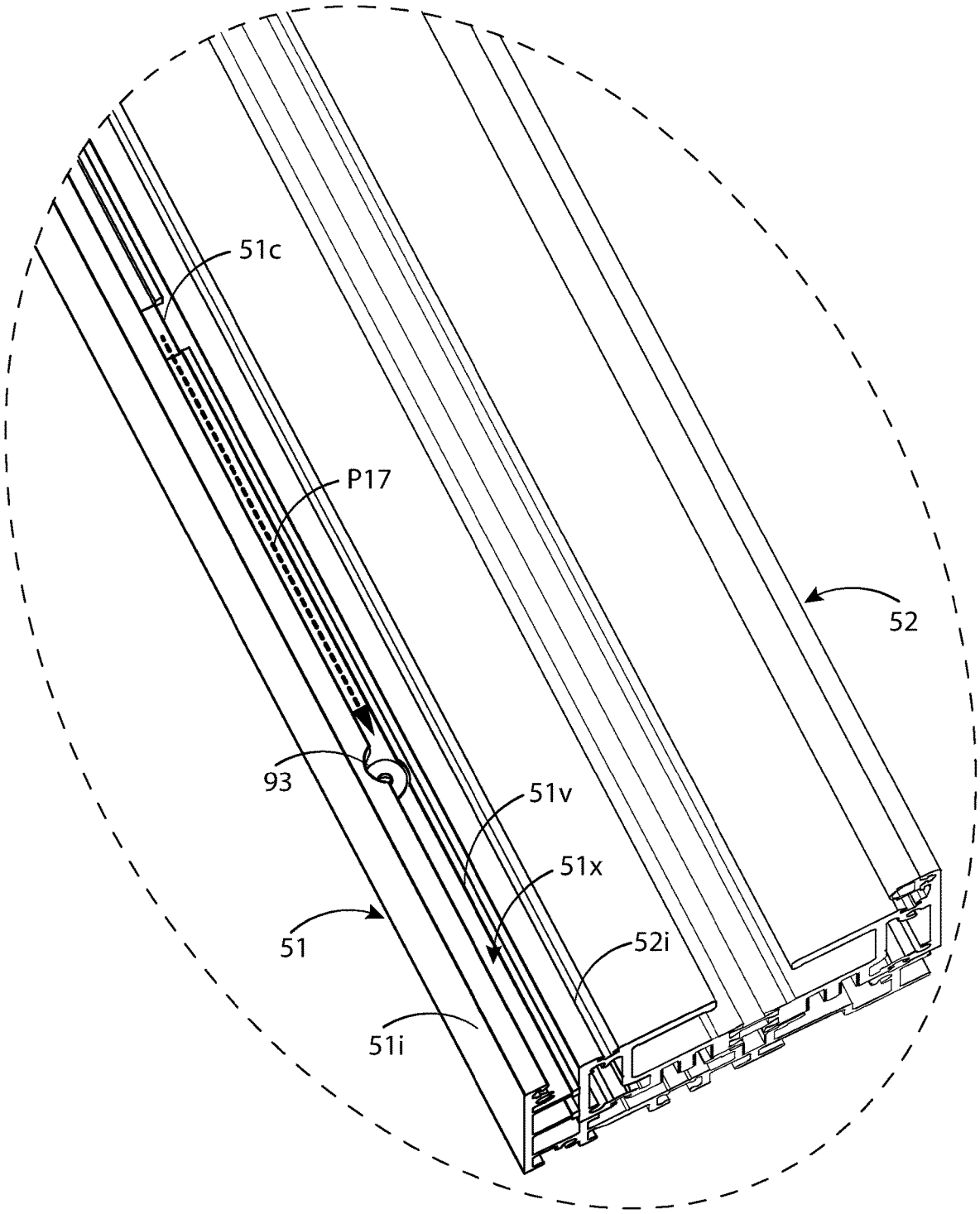
FIG. 23 illustrates a right and rear portion of FIG. 22 enlarged to illustrate details of the rear drain channel and an upper drain aperture.
Figure 26:
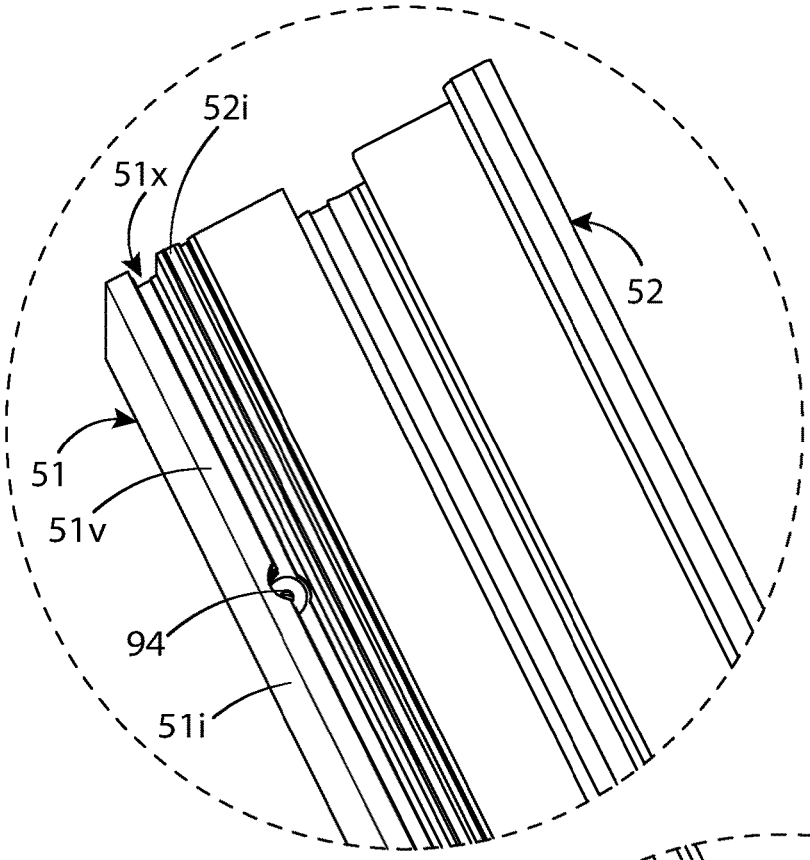
FIG. 26 illustrates a left and rear portion of FIG. 22 enlarged to illustrate details of the rear drain channel and two of the upper drain apertures.
Figure 25:
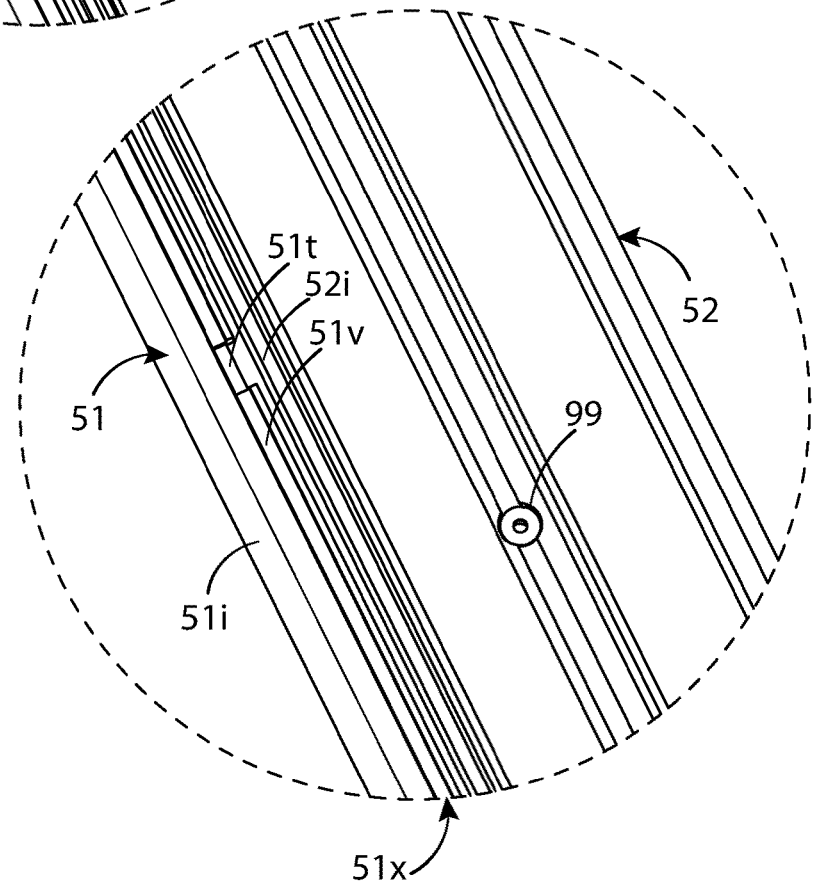
FIG. 25 illustrates a mid and rear portion of FIG. 22 enlarged to illustrate details of the rear drain channel and an upper drain aperture, and an optional mid-drain aperture.

FIGS. 23, 25, and 26 illustrate enlarged portions of FIG. 22 showing portions of the trough 51*x* in detail. Referring to FIGS. 23, 25, and 26, trough 51*x* can be formed between the subsill back wall 51*i* and the sill back wall 52*i* with the partition 51*v* as the bottom of the trough. Referring to FIG. 21, partition 51*v* is illustrated as forming the top wall of pressure chamber PC14. Aperture 51*c* is illustrated in FIG. 23. Aperture 51*t* is illustrated in FIG. 25. The apertures 51*c*, 51*t* of FIGS. 23 and 25, respectively, can be notched, milled, punched, or otherwise cut out. Apertures 51*c*, 51*t* is enclosed on three sides by partition 51*v* and enclosed on one side by the sill back wall 52*i*. The partition 51*v* can include an end portion that extends Upward as illustrated, or can extend downward or both upward and downward. The end portions provide greater surface area against the sill back wall 52*i* and to help create a better seal. A gasket, silicone, and/or other water-tight sealants at the junction between the partition 51*v* and the sill back wall 52*i* can help create a good seal and facilitate the function of the pressure chamber PC14 of FIG. 21. While two openings are illustrated, one or more openings can be used depending on the length of the sill, the volume of pressure chamber PC14, and drainage requirements.

Figure 24:
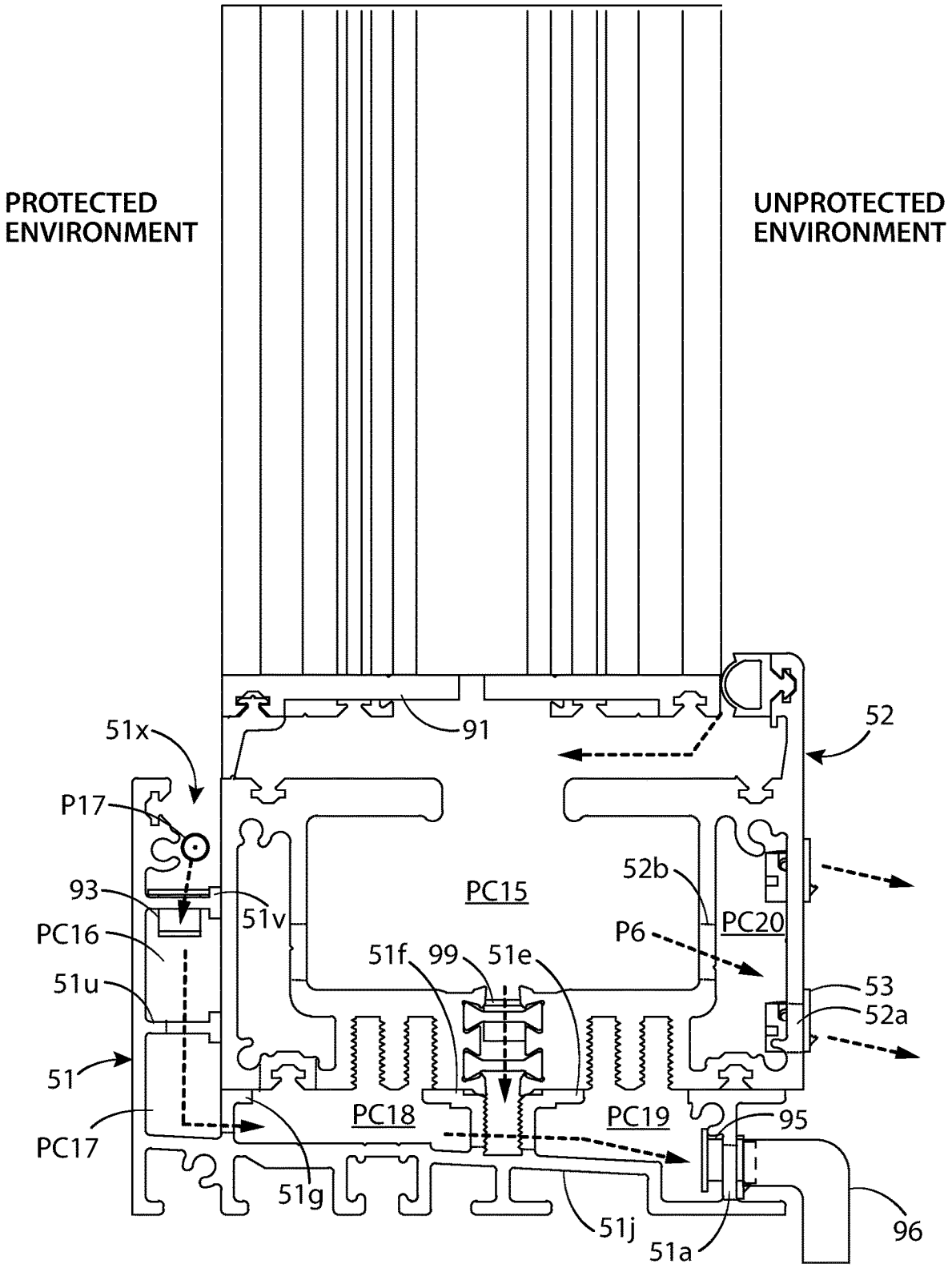
FIG. 24 illustrates a left-side view the sill assembly a portion of the folding door of FIG. 22 illustrating alternative drainage path through auxiliary chambers.

FIG. 21 illustrates optional drain paths into the subsill 51 as well as additional pressure chambers within the sill 52. FIGS. 24 and 25 describe an additional drain path. Referring to FIGS. 21 and 24, pressure chamber PC20 provides an additional barrier within the sill 52 to mitigate water penetration. Water entering the weep hole 52*a* and from weep flap 53 from the unprotected environment would have to overcome the height difference between aperture 52*b* and the weep hole 52*a* before entering further into the sill 52. Referring to FIG. 21, water entering pressure chamber PC15 can optionally drain into pressure chamber PC21 through drain hole 52*c*. Aperture 52*d* can drain water from pressure chamber PC21 into the subsill. Referring to FIG. 24 water can optionally drain out of pressure chamber PC15 into the subsill 51 through one-way valve 99. One-way valve 99 is also illustrated in FIG. 25. The number and placement of these optional drain paths depends on performance requirement and sill length. For example, for higher performance environments such as those areas prone to wind storms and hurricanes, it may be desirable to provide additional drain paths, such as some or all of those described in this paragraph as well as additional pressure chambers.

While a single plurality of pressure chambers can extend across the entire length of the sill, the inventor discovered he might improve the drainage capacity by creating more than one plurality of pressure chambers placed side-by-side along the length of the sill assembly as illustrated in FIGS. 1, 9, and 18. The multiple plurality of pressure chambers could be divided by a barrier in combination with the trough 31*x*, 41*x*, 51*x* of FIGS. 4, 12, and 22, respectively, to allow water overflow to migrate from one plurality of pressure chambers to another. FIG. 1 illustrates a second plurality of pressure chambers created by barrier 101. FIG. 9 illustrates a second plurality of pressure chambers created by barrier 102. FIG. 18 illustrates a second plurality of pressure chambers created by barrier 103. The barriers 101, 102, 103 can be made of silicone, poured foam, or other materials that creates air and water resistance between the chambers.

Referring to FIG. 1, water flowing through the second plurality of pressure chambers can be routed through apertures 31*q*, 31*p*, 31*s*, 31*t* that are positioned in such a way as to create a circuitous route for water and air to flow in and out of weep hole 31*b* and weep flap 36. Apertures 31*p*, 31*q*, 31*s*, 31*t* can be cut or formed in the partitions 31*h*, 31*g*, 31*f*, 31*e*, respectively, as previously described. Referring to FIG. 9, water flowing through the second plurality of pressure chambers can be routed through apertures 41*w*, 41*t*, 41*s*, 41*r*, 41*q*, 41*p* that are positioned in such a way as to create a circuitous route for water and air to flow in and out of weep hole 41*b* and weep flap 46. Apertures 41*w*, 41*t*, 41*s*, 41*r*, 41*q*, 41*p* can be cut or formed in the partitions 41*v*, 41*u*, 41*h*, 41*e*, 41*g*, 41*f*, respectively, as previously described. Referring to FIG. 18, water flowing through the second plurality of pressure chambers can be routed through apertures 51*t*, 51*s*, 51*r*, 51*q*, 51*p* that are positioned in such a way as to create a circuitous route for water and air to flow in and out of weep hole 51*b* and weep flap 56.

The following are some examples of how the first plurality of pressure chambers could be used as an overflow for the second plurality of pressure chambers. Referring to FIG. 1, if water was to infiltrate the subsill 31 through weep flap 36, and fill the second plurality of pressure chambers, the water could overflow through the trough 31*x* (FIG. 4), enter the first plurality of pressure chambers, and drain out of weep flap 35 (FIG. 1). Referring to FIG. 9, if water was to infiltrate the subsill 41 through weep flap 46, and fill the second plurality of pressure chambers, the water could overflow through the trough 41*x* (FIG. 12), enter the first plurality of pressure chambers, and drain out of weep flap 45 (FIG. 9). Referring to FIG. 18, if water was to infiltrate the subsill 51 through weep flap 56, and fill the second plurality of pressure chambers, the water could overflow through the trough 51*x* (FIG. 22), enter the first plurality of pressure chambers, and drain out of weep flap 55 (FIG. 18).

Note that the same set of examples could apply for water overflowing from the first plurality of pressure chambers to the second plurality of pressure chambers. For example, in FIG. 1, if weep flap 35 was compromised, water could infiltrate through it. If the first plurality of pressure chambers were to exceed capacity, the water could overflow through trough 31*x* (FIG. 4) and enter the second plurality of pressure chambers and drain out of weep flap 36 (FIG. 1). A second example. Referring to FIG. 9, if weep flap 45 were compromised, and weep flap 46 were not compromised, water could infiltrate through weep flap 45, and if the first plurality of pressure chambers were to exceed capacity, the water could overflow through trough 41*x* (FIG. 12) and enter the second plurality of pressure chambers and drain out of weep flap 46 (FIG. 9). A third example. Referring to FIG. 18, if weep flap 55 were compromised, and weep flap 56 were not compromised, water could infiltrate through weep flap 55, and if the first plurality of pressure chambers were to exceed capacity, the water could overflow through trough 51*x* (FIG. 22) and enter the second plurality of pressure chambers and drain out of weep flap 56 (FIG. 18).

In addition, to the first and second plurality of pressure chambers described for FIGS. 1, 9, and 18, additional plurality of pressure chambers could be added side-by-side, where each could act as an overflow for the other. To further enhance performance, additional plurality of pressure chambers could also be constructed that are isolated from the wind, rain, and the air and water pressure of the front of the subsill and sill. Examples of overflow chambers that are isolated from the wind and rain are illustrated for sill assembly 50. The principles described below for these overflow chambers can also be applied to the sill assemblies 30, 40 of FIGS. 1 and 9 respectively.

Referring to FIG. 22, water that overflows from apertures 51*c* and 51*t* into the trough 51*x* can drain through one-way valves 93, 94. FIG. 23 shows in more detail the flow of water from aperture 51*c* to one-way valve 93 by path P17. Path P17 is also show in trough 51*x* in FIG. 24 as a circle with a concentric dot, representing the direction of flow as coming toward one-way valve 93. One-way valve 94 is shown in more detail in FIG. 26. The one-way valve allows water or fluid accumulated in trough 51*x* to drain out, but prevents backflow. The one-way valves 93, 94 of FIG. 22 can be a ball valve, check valve or other anti-back flow valve known in the art.

Referring to FIG. 24, the water from path P17 flows through pressure chambers PC16, PC17, PC18, PC19, through apertures in partitions 51*v*, 51*u*, 51*g*, 51*f*, 51*e*, and drains out through one-way valve 95. Partition 51*v* is illustrated as forming the top wall of pressure chamber PC16. A drain tube 96 can optionally be connected to one-way valve. 95 and drain the water into a drain trough, French drain, drain pipe, storm pipe, or other external drainage. The external drainage can be isolated from the rain, wind, and external pressure to provide additional drainage as compared with the one-way valve being exposed to the rain, wind, and air pressure as the weep holes and weep flaps. Weep hole 51*a*, one-way valve 95 and drain tube 96 can optionally be positioned through the subsill bottom wall 51*j* of the subsill 51.

Figure 27:
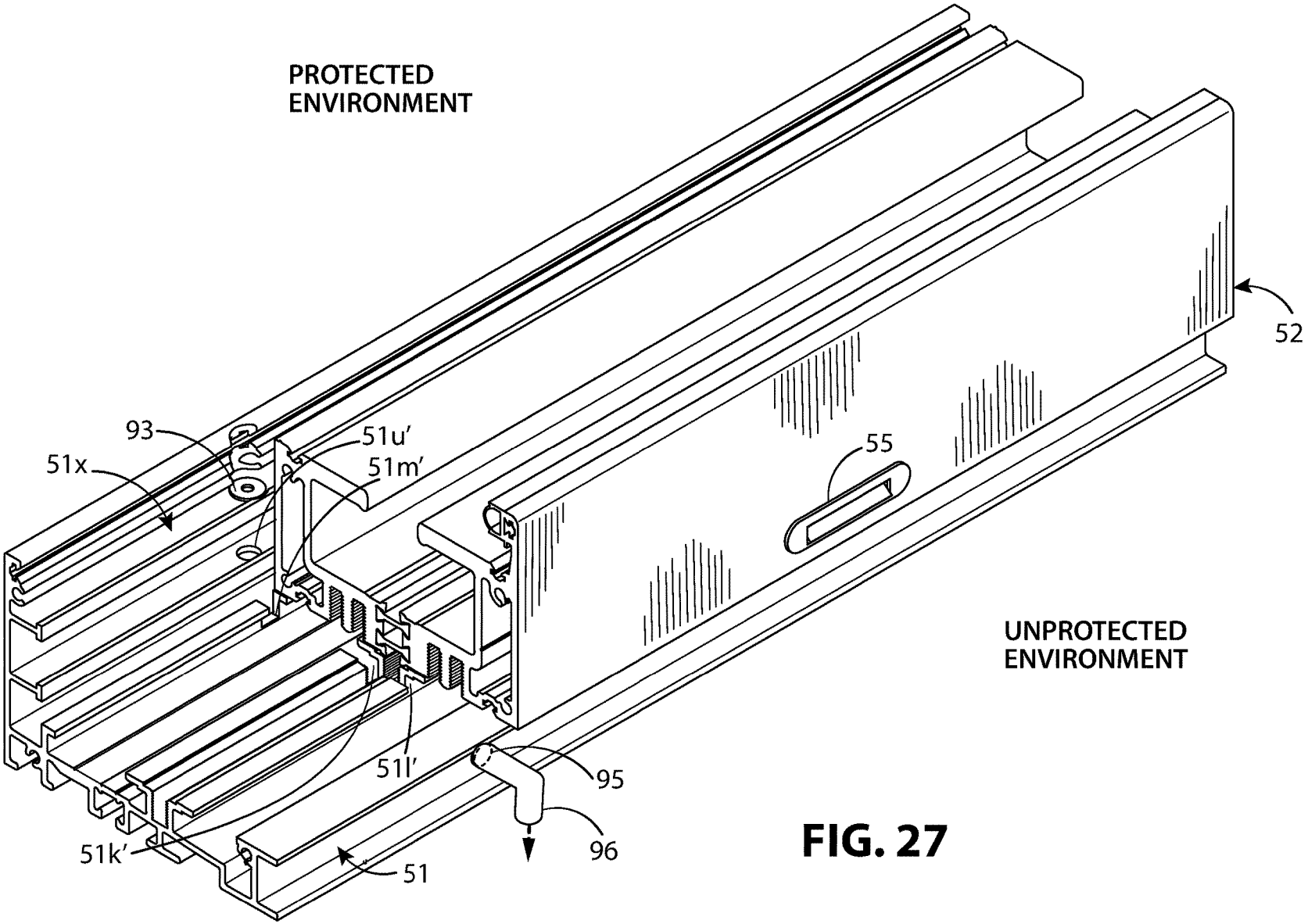
FIG. 27 illustrates a left-side portion, in perspective view, of the sill assembly of FIG. 18 with a portion of the sill cutaway to show how apertures in the subsill with an overflow chamber interface with the sill.

As illustrated in FIG. 27, water can optionally flow through the overflow chambers by a direct path when water drains into a different environment than the other drain paths. For example, in FIG. 27, water flows from the trough 51*x* through one-way valve 93, and apertures 51*u*', 51*m*', 51*l*', 51*k*', one-way valve 95, and drain tube 96 in a direct path. In this example, drain tube 96 can drain into external drainage isolated from the unprotected environment presented at weep flap 55 of sill 52.

Pressure chambers PC16, PC17, PC18, PC19 of FIG. 24 are isolated from pressure chambers PC11, PC12, PC13, PC14 of FIG. 21 by a barrier that extends across (i.e., transversely) the cavities between the sill 52 and subsill 51. Barriers 97, 98 are shown in FIG. 18. Barrier 97 is also shown in FIG. 28. Barrier 98 in FIG. 18 similarly isolates the pressure chambers associated with one-way valve 94. The barriers 97, 98 of FIG. 18 can be made of any combination of materials that prevents water and air flowing between lengthwise adjacent pressure chambers. For example, the barriers could be formed from poured foam, silicone, or plastic that is sealed with water-tight adhesive and/or silicone. In FIG. 28, barrier 97 is divided into barrier portions 97*a*, 97*b*, 97*c*, 97*d*, 97*e*, with each barrier portion corresponding to an air gap that needs to be filled between the subsill 51 and the sill 52 to isolate corresponding lengthwise adjacent pressure chambers from each other. In this example, barrier portion 97*a* of FIG. 28 isolates pressure chamber PC11 of FIG. 21 from pressure chamber PC19 of FIG. 24. Barrier portion 97*c* of FIG. 28 isolates pressure chamber PC12 of FIG. 21 from pressure chamber PC18 of FIG. 24. Barrier portion 97*d* of FIG. 28 isolates PC13 of FIG. 21 from pressure chamber PC17 of FIG. 24. Barrier portion 97*e* of FIG. 28 isolates pressure chamber PC14 from pressure chamber PC16. Barrier portion 97*b* of FIG. 28 isolates the air space between partitions 51*e*, 51*f* in FIG. 21 from the air space between partitions 51*e*, 51*f* in FIG. 24.

Sill assemblies and subsills for the sill assemblies have been described. It is not the intent of this disclosure to limit the claims to the examples, and variations described in the specification. Those skilled in the art will recognize that variations will occur when embodying the claims in specific implementations and environments. For example, FIGS. 3, 11, and 21 demonstrate some examples of implementing a pressure chamber between the sill and subsill. The partitions 31*e*, 31*f*, 31*g* of FIG. 3, partitions 41*e*, 41*f*, 41*g*, 41*h* of FIG. 11, and partitions 51*e*, 51*f*, 51*g* of FIG. 21 are shown as uplegs extending directly upward from the subsill bottom wall 31*j* of FIG. 3, subsill bottom wall 41*j* of FIG. 11, and subsill bottom wall 51*j* of FIG. 21, respectively. In the case where the subsill is extruded, cast, or molded, the uplegs can be part of the extrusion, casting, or molding, respectively. The uplegs are illustrated as being L-shaped with the base of the L engaging the sills 32, 42, 52 of FIGS. 3, 11, and 21, respectively. However, the uplegs can be any shape that allows the sills 32, 42, 52 to be supported by their respective subsills, subsills 31, 41, 51, under normal day-to-day operations. For example, the uplegs can be I-shaped or t-shaped.

FIG. 21 shows an example of the uplegs, partitions 51*e*, 51*f*, 51*g*, engaging the bottom surface of the sill 52 directly. In FIGS. 3 and 11, the uplegs engage down legs. The down legs extend downward from their respective sill. In FIG. 3, partitions 31*f*, 31*g* engage sill down legs 32*b*, 32*c*, respectively. In FIG. 11, partitions 41*f*, 41*g*, 41*h* engage sill down legs 42*b*, 42*c*, 42*d*, respectively. The sill down legs 32*b*, 32*c* of FIG. 3 and sill down legs 42*b*, 42*c*, 42*d* of FIG. 11 are illustrated as L-shaped, but other shapes can be used to provide a stable base for the sills 32, 42 of FIGS. 3 and 11, respectively.

The pressure chambers formed between the sills 32, 42, 52 and subsill 31, 41, 51 of FIGS. 3, 11, 21, respectively, can be sealed by adhesive, sealant, threaded fasteners, or non-threaded fasteners (such as pins). For example, a combination of silicone and threaded fasteners can provide a secure seal between the sills and subsills. In some implementations, silicone, structural silicone, or a water-tight adhesive could seal without the use of threaded fasteners. Those skilled in the art of door and window construction will appreciate that there are many appropriate ways to seal the sill to the subsill and provide a water-tight and air-tight seal.

It is possible to combine features described in separate examples together within a single example. Similarly, it is possible to import features described in one example to other implementations. For example, the overflow chambers for sill assembly 50 of FIG. 18 can be adapted for the sill assemblies 30, 40 of FIGS. 1 and 9, respectively. A barrier, for example like the barrier 97 of FIGS. 18 and 28, can separate the overflow pressure chambers added to FIGS. 1 and 9 from the respective first plurality of pressure chambers. The overflow pressure chambers added to FIGS. 1 and 9 can be placed on the periphery of the sill assembly, as illustrated for overflow pressure chambers of FIG. 18. Alternatively, the overflow pressure chambers added to FIGS. 1 and 9 as well as overflow chambers in FIG. 18, can be placed anywhere along the length of the sill assembly as appropriate, for example near the center of the sill assembly. In the case where they are not placed on the periphery, two barriers would be required to separate the overflow chambers from the other pressure chambers. In addition, the sill assembly of FIG. 18 can be implemented without overflow chambers.

While FIGS. 2, 10, and 19 illustrate how various circuitous routes can be formed in the subsill 31, 41, 51, respectively, to create circuitous routes through the corresponding sill assemblies, the apertures that create the circuitous routes can be moved, widened, or narrowed, or removed to create other circuitous routes. FIGS. 1 and 9 show two plurality of pressure chambers positioned side-by-side along the length of sill assemblies 30, 40, respectively. FIG. 21 illustrates two plurality of pressure chambers positioned side-by-side and two sets of overflow chambers. Depending on installation factors, such as sill length, or water and air performance other arrangements are possible. For example, a single plurality of pressure chambers could extend the entire length of sill assembly 30, 40, 50 of FIGS. 1, 9, and 21, respectively. As an example, referring to FIG. 9, barrier 102 could be removed. Apertures 41*k*, 41*q*, 41*r*, 41*n*, 41*t*, 41*c* and weep hole 41*b* could be removed or sealed with a water-tight and air-tight sealant. This would cause water to flow through apertures 41*w*, 41*o*, 41*s*, 41*m*, 41*l*, 41*p*, and weep flap 45. Other paths are possible simply by selectively removing or sealing apertures, or moving the position of apertures. The same principles can be applied to the sill assembly 30 of FIG. 1 and sill assembly 50 of FIG. 18.

The sill 52 of FIG. 21 can be modified so that the bottom surface of the sill 52 includes down legs, for example, the down legs 32*b*, 32*c* of FIG. 3 or the down legs 42*b*, 42*c*, 42*d* of FIG. 11. In addition, other variations of down legs, for example, I-shaped or t-shaped, could be implemented in FIG. 21. Similarly, the sills 32, 42 of FIGS. 3 and 11, respectively could be modified to eliminate the down legs so that the partitions 31*f*, 31*g* of FIG. 3 and/or 41*f*, 41*g*, 41*h* of FIG. 11 could engage the bottom surface of the sill 32, 42 without the use of down legs. For example, the down legs 32*b*, 32*c* of FIG. 3 and down legs 42*b*, 42*c*, 42*d* of FIG. 11 could be eliminated by simply thickening the bottom surfaces of the sills 32, 42 of FIGS. 3 and 11, respectively. The inventor envisions that these variations fall within the scope of the claims.

While the sill assemblies 30, 40, 50 of FIGS. 3, 11, and 21 are illustrated for swing door 70, sliding door 80, and folding door 90, they can be used for casement windows, sliding windows, and folding windows, respectively, either as shown or with minor modification. For example, the sill assembly 30 of FIG. 3 could be implemented for a casement window directly as shown, or could be modified with a sill apron over the sill 32 for aesthetics. The sill assemblies 30, 40, 50 of FIGS. 3, 11, and 21 could be widthwise narrowed, as appropriate, to accommodate a narrower window opening or to allow for wide interior window brickmold casing. The sill assemblies 30, 40, 50 could be used, as illustrated with little or no modification, for egress windows.

The swing door 70 illustrated in FIGS. 3, 4, and 8 is shown as an inswing door (i.e., opening into the protected environment). Referring to FIG. 3, the sill assembly 30 could be adapted for use with an outswing door by lowering the height of the sill front wall 32*d* sufficiently so the frame bottom 71*a* of the door frame 71 clears the sill front wall 32*d*, allowing the swing door 70 to swing outward. In addition, the height of the sill back wall 32*i* can be raised above the frame bottom 71*a* of the door frame 71 to act as a door stop and door seal. Note that the door seal 72 would be repositioned to the front of the swing door 70, for example it could be secured to slot 71*b*.

Referring to FIGS. 1, 8, and 18, the structure that determines the routing of the water through the pressure chambers, as well as the structure of the pressure chambers themselves depends primarily on the structure of the subsill 31, 41, 51, respectively. The interaction with the door is determined primarily by the sill, for example sills 32, 42, 52 of FIGS. 1, 8, and 19, respectively. Therefore, the structure of the pressure chambers, the routing of water via circuitous routes, the trough, and overflow chambers that have been described can be implemented independent of door type since these features depend primarily on the subsill.

While the examples and variations are helpful to those skilled in the art in understanding the claims, the scope of the claims is defined by the claims and their equivalents.

What is claimed is:

1. A device for use with a sill, comprising:

a subsill positioned at least partially below the sill;

a plurality of pressure chambers positioned between the sill and the subsill and extending lengthwise along the subsill; and apertures arranged in the plurality of pressure chambers in such a way that forces water passing through the plurality of pressure chambers to be routed circuitously lengthwise along the subsill.

2. The device of claim 1, wherein:

the plurality of pressure chambers includes a first pressure chamber and a second pressure chamber with the second pressure chamber positioned behind the first pressure chamber.

3. The device of claim 2, wherein:

the subsill includes a subsill bottom wall and a subsill back wall, each extending lengthwise along the subsill;

the subsill back wall projecting upward from the subsill bottom wall and positioned behind the sill; and the second pressure chamber is formed between the subsill back wall and the sill.

4. The device of claim 3, further comprising:

a trough extending lengthwise along the subsill is formed above the second pressure chamber between the subsill back wall and the sill.

5. The device of claim 3, further comprising:

the plurality of pressure chambers includes a third pressure chamber extending lengthwise along the subsill, the third pressure chamber positioned above the second pressure chamber and between the subsill back wall and the sill.

6. The device of claim 1, further, comprising:

a second plurality of pressure chambers, positioned between the subsill and the sill, extending lengthwise along the subsill, and positioned lengthwise adjacent to the plurality of pressure chambers;

the sill including a sill back wall and the subsill including a subsill back wall with a trough formed therebetween; and the plurality of pressure chambers, the second plurality of pressure chambers, and the trough are arranged so water flowing into the trough from the plurality of pressure chambers can drain into the second plurality of pressure chambers.

7. The device of claim 1, wherein:

two or more apertures of the apertures being offset lengthwise with respect to the subsill to force water passing through the plurality of pressure chambers to be routed circuitously lengthwise along the subsill.

8. A sill assembly, comprising:

a sill;

a subsill positioned at least partially below the sill;

a plurality of pressure chambers positioned between the sill and the subsill and extending lengthwise along the subsill; and apertures arranged in the plurality of pressure chambers in such a way that forces water passing through the plurality of pressure chambers to be routed circuitously along a path lengthwise with respect to the sill and the subsill.

9. The sill assembly of claim 8, wherein:

the plurality of pressure chambers includes a first pressure chamber and a second pressure chamber with the second pressure chamber positioned behind the first pressure chamber.

10. The sill assembly of claim 9, wherein:

the subsill includes a subsill bottom wall and a subsill back wall, each extending lengthwise along the sill assembly, the subsill back wall projecting upward from the subsill bottom wall;

the sill includes a sill back wall positioned in front of the subsill back wall; and the second pressure chamber is formed between the sill back wall and the subsill back wall.

11. The sill assembly of claim 10, further comprising:

a trough extending lengthwise along the sill assembly is formed above the second pressure chamber between the subsill back wall and the sill back wall.

12. The sill assembly of claim 10, further comprising:

the plurality of pressure chambers includes a third pressure chamber extending lengthwise along the subsill, the third pressure chamber positioned above the second pressure chamber and between the sill back wall and the subsill back wall.

13. The sill assembly of claim 10, further comprising:

the plurality of pressure chambers includes a third pressure chamber extending lengthwise along the subsill, the third pressure chamber positioned above the second pressure chamber and between the sill back wall and the subsill back wall; and a trough extending lengthwise along the sill assembly is formed above the third pressure chamber between the subsill back wall and the sill back wall.

14. The sill assembly of claim 8, further, comprising:

a second plurality of pressure chambers, positioned between the sill and the subsill, extending lengthwise along the subsill, and positioned lengthwise adjacent to the plurality of pressure chambers;

the sill including a sill back wall and the subsill including a subsill back wall with a trough formed therebetween; and the plurality of pressure chambers, the second plurality of pressure chambers, and the trough are arranged so water flowing into the trough from the plurality of pressure chambers can drain into the second plurality of pressure chambers.

15. The sill assembly of claim 8, wherein:

two or more apertures of the apertures being offset lengthwise with respect to the sill and subsill to force water passing through the plurality of pressure chambers to be routed circuitously.

16. The sill assembly of claim 8, wherein the sill that is separate from and positioned below a door or a window.

* * * * *